US005581219A

United States Patent [19]

Nozawa et al.

[11] Patent Number: 5,581,219

[45] Date of Patent: Dec. 3, 1996

[54] CIRCUIT BREAKER

[75] Inventors: Eiji Nozawa; Naoshi Uchida; Masao Miura; Tsuneo Ebisawa, all of Kanagawa, Japan

[73] Assignee: Fuji Electric Co., Ltd., Kanagawa, Japan

[21] Appl. No.: 963,651

[22] Filed: Oct. 20, 1992

[30] Foreign Application Priority Data

| | | | |
|---|---|---|---|
| Oct. 24, 1991 | [JP] | Japan | 3-305466 |
| Dec. 27, 1991 | [JP] | Japan | 3-359768 |
| Apr. 7, 1992 | [JP] | Japan | 4-114064 |
| Aug. 11, 1992 | [JP] | Japan | 4-235222 |
| Aug. 25, 1992 | [JP] | Japan | 4-248749 |

[51] Int. Cl.[6] ..... H01H 67/02

[52] U.S. Cl. ..... 335/132; 335/8; 361/42

[58] Field of Search ..... 335/8–9, 6, 35, 335/132, 131, 202; 361/42–50

[56] References Cited

U.S. PATENT DOCUMENTS

| | | | |
|---|---|---|---|
| 4,595,812 | 6/1986 | Tamaru et al. | 335/132 |
| 4,622,444 | 11/1986 | Kandatsu et al. . | |
| 4,641,217 | 2/1987 | Morris et al. | 361/45 |
| 4,754,247 | 6/1988 | Raymont et al. . | |
| 4,884,048 | 11/1989 | Castonguay et al. | 335/18 |
| 4,913,503 | 4/1990 | Castonguay et al. . | |
| 5,157,366 | 10/1992 | Mullins et al. | 335/8 |
| 5,162,766 | 11/1992 | Morris et al. | 335/202 |
| 5,197,594 | 3/1993 | Drexler et al. | 335/132 |

FOREIGN PATENT DOCUMENTS

| | | |
|---|---|---|
| 54-124270 | 9/1979 | Japan . |
| 64-52360 | 2/1989 | Japan . |
| 2-144819 | 6/1990 | Japan . |

*Primary Examiner*—Lincoln Donovan

*Attorney, Agent, or Firm*—Finnegan, Henderson, Farabow, Garrett & Dunner, L.L.P.

[57] ABSTRACT

A circuit breaker comprises a container made of electrically insulating material, the container being constituted by a casing and a cover; a switching mechanism contained in the container; partition walls defining a recess in the casing, the recess being separated from an interior of the container by the partition walls; and a base made of electrically insulating material, on which an accessory which is in the form of a cassette is detachably mounted, the base being detachably mounted in the recess formed in the cover.

9 Claims, 21 Drawing Sheets

CIRCUIT BREAKER

BACKGROUND OF THE INVENTION

1. Field of the Invention

This invention relates to circuit breakers such as wiring breakers and earth leakage breakers, and more particularly to the mounting of accessories such as an alarm switching, auxiliary switch, undervoltage trip unit, and voltage trip unit which are built in such a circuit breaker.

2. Description of the Prior Art

Of those accessories, the auxiliary switch is to electrically indicate the "on" and "off" states of the circuit breaker, and the alarm switch is to electrically indicate the trip of the circuit breaker, the undervoltage trip unit is to trip the circuit breaker when the circuit voltage is decreased to lower than a predetermined value, and the voltage trip unit is to electrically trip the circuit breaker at a remote position.

A wiring breaker or earth leakage breaker comprises: an container of electrically insulated material which is made up of a casing and a cover; and a switching mechanism set in the insulated container. The aforementioned accessories are built in the insulated container according to the specification during manufacture of the circuit breaker. Therefore, it is impossible for the user to exchange the accessories for other ones or to add desired accessories to the circuit breaker.

In order to overcome this difficulty, the following circuit breaker has been proposed in the art (cf. Japanese Patent Application (OPI) No's 124270/1979, 52360/1989, and 144819/1990 (the term "OPI" as used herein means an "unexamined published application")). In the circuit breaker, the accessories are not built in the insulated container, and instead they are formed as units, and detachably mounted in recesses from outside which are formed in the cover, so that the user can replace them or add desired accessories.

In a conventional circuit breaker of this type, the accessories are mounted directly on the cover. Hence, the circuit breaker suffers from the following difficulties: Accessories which can be mounted on the cover are limited by the configurations of the recesses formed in the cover, and accordingly the combination of accessories, and the selection of specifications are unavoidably small in the degree of freedom.

For instance, micro-switches used for the auxiliary switch and the alarm switch are different in configuration and in size depending on the manufacturers, contact structures and rating. Therefore, even if they are formed as units, it is difficult to unify them in configuration and size. Accordingly, it is necessary to provide a variety of covers different in recess configuration; however, it is not economical to do so. Furthermore, it is limited to make the recesses intricate in configuration because a great internal pressure acts on the cover when the circuit breaker is operated to interrupt short-circuit current. Thus, the conventional circuit breaker cannot meet the requests of the user.

SUMMARY OF THE INVENTION

Accordingly, an object of this invention is to provide a circuit breaker which is advantageous in that it can be freely achieved to replace the accessories and to add desired accessories, and it has various merits which cannot be provided by a conventional circuit breaker.

The foregoing object of the invention has been achieved by the provision of a circuit breaker in which the accessories are not directly mounted in the recesses of the cover; that is, a base of electrically insulating material is provided, and an accessory in the form of a cassette is detachably mounted on the base, and the base is detachably mounted in a recess formed in the cover.

In this connection, it is preferable that the circuit breaker is so designed that the base is provided in common for a plurality of accessories; that is, a number of accessories can be mounted on one and the same base.

Since the base is interposed between the cover and the accessories, the latter are not limited by the configuration and dimension of the recesses of the cover, and a variety of accessories can be mounted by employing a variety of bases. Hence, the recess of the cover can be simplified in configuration, and therefore the mechanical strength of the cover is not reduced by the formation of the recess.

The circuit breaker may be so designed as to employ an accessory module which is formed by mounting a plurality of accessory on a common base. In this case, a number of accessories can be mounted, as one unit, on the circuit breaker or demounted therefrom, and the change in combination of the accessories or the wiring of the latter can be achieved on the base separated from the circuit breaker.

DETAILED DESCRIPTION OF THE PREFERRED EMBODIMENTS

A three-pole wiring circuit breaker, which constitutes an embodiment of this invention, will be described with reference to the accompanying drawings.

Figure 1:
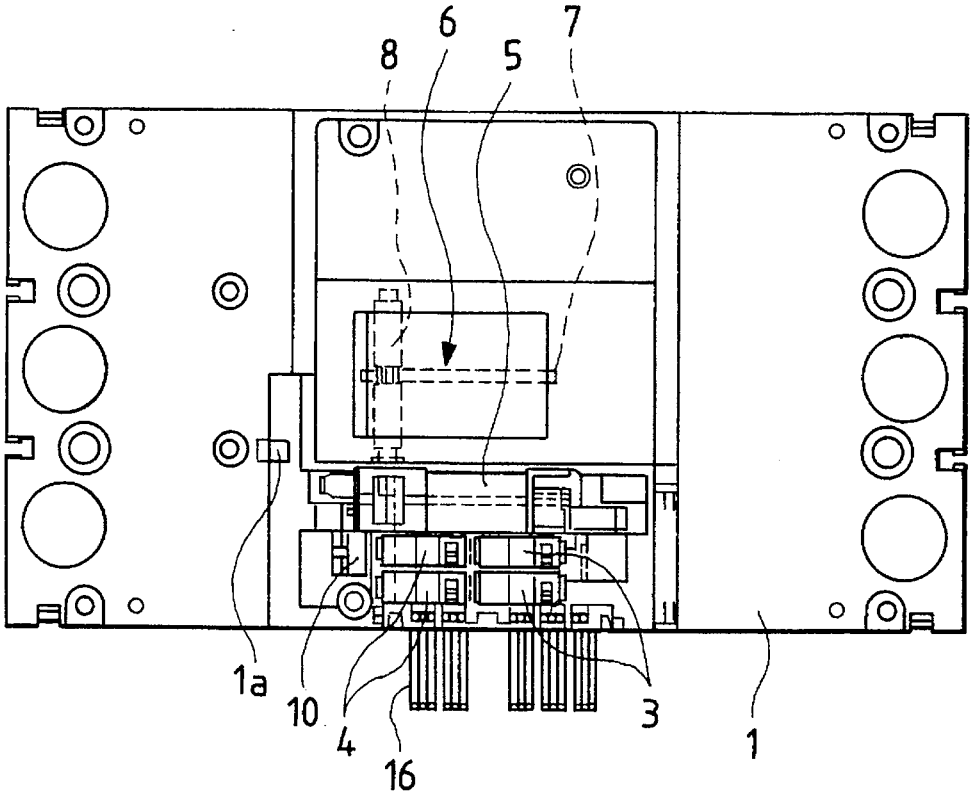
FIG. 1 is a plan view showing one example of a circuit breaker, which is one embodiment of this invention, from which an auxiliary cover has been removed.

FIG. 1 is a plan view of the circuit breaker. The left side of FIG. 1 shows the power source of the circuit breaker, and the right side, the load side. The circuit breaker has a cover 1 having recesses (described later), which are utilized to mount two auxiliary switches 3, two alarm switches 4, and one trip unit (an undervoltage trip unit or voltage trip unit) 5. Those accessories are set on one side (the side of R-phase) of a switching (opening and closing) mechanism 6 (only latch 7 and a latch pin 8 supporting the latter 7 shown) positioned in the middle phase (S-phase).

Figure 2:
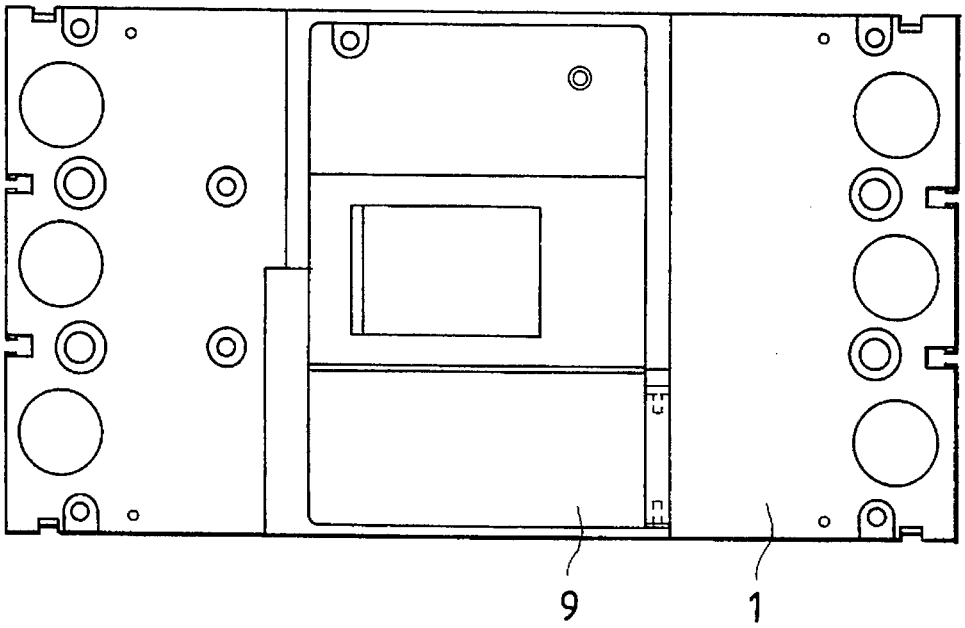
FIG. 2 is a plan view of the circuit breaker on which the auxiliary cover is mounted.
Figure 3:
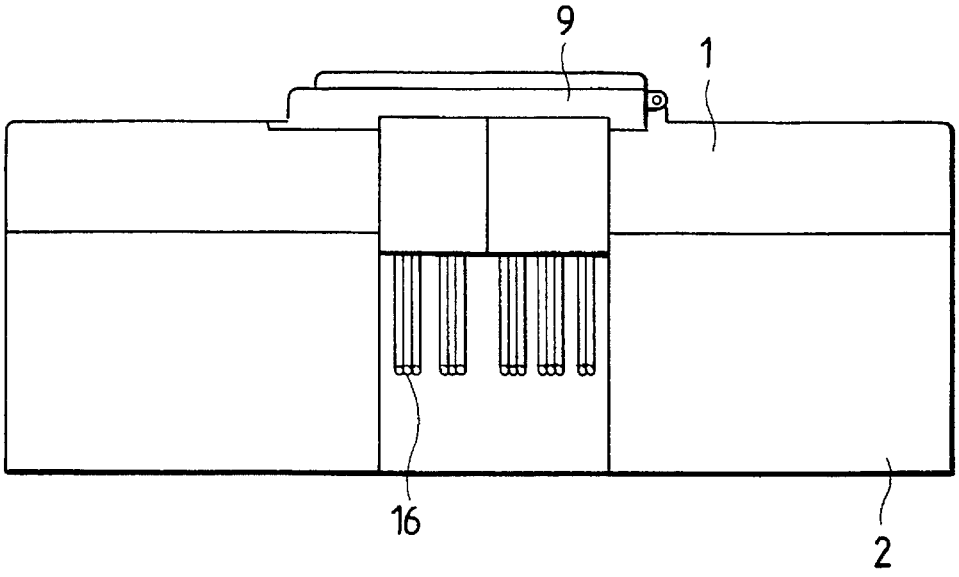
FIG. 3 is a side view of the circuit breaker shown in FIG. 2.

FIG. 1 shows the circuit breaker from which an auxiliary cover for covering the accessories has been removed. FIG. 2 shows the circuit breaker in which the auxiliary cover 9 is mounted on the cover 1. FIG. 3 is a side view of the circuit breaker with the auxiliary cover 9 set on the cover 1. In FIG. 3, reference numeral 2 designates a casing.

Figure 4A:
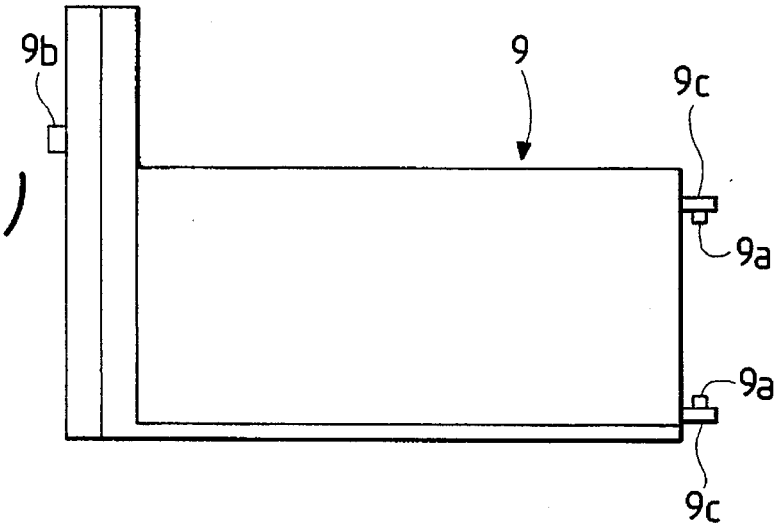
FIGS. 4(A) and 4(B) are a plan view and a front view of the auxiliary cover shown in FIG. 2, respectively.
Figure 4B:
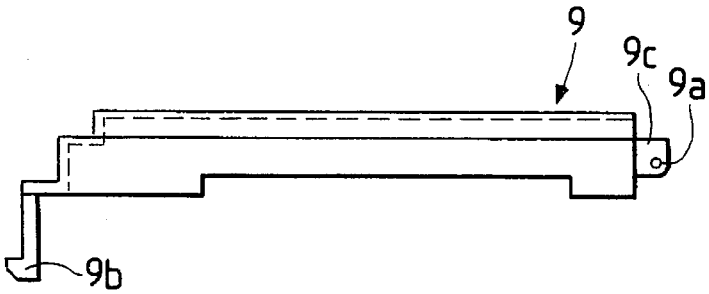

The auxiliary cover 9 is shaped as shown in FIGS. 4(A) and 4(B). The auxiliary cover 9 has a pair of protruded pins 9*a* at one end, through which it is swingably supported on the cover 1. The auxiliary cover 9 has a pawl 9*b* on the other end, which is engaged with a hole 1*a* (FIG. 1) formed in the cover 1, so that it is fixedly held on the cover 1. The pins 9*a* are extended inwardly from arms 9*c*, respectively, and they are fitted into bearing holes formed in the cover 1 by the elastic deformation of the arms 9*c*. The pins 9*a* may be extended outwardly from the arms 9*c* as the case may be.

Figure 5:
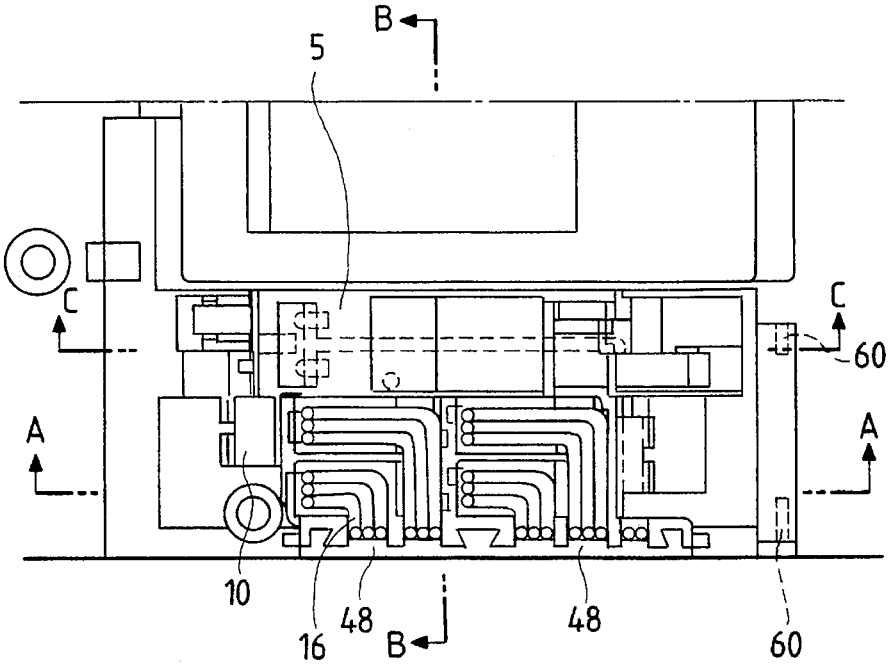
FIG. 5 is an enlarged diagram showing essential parts of the circuit breaker shown in FIG. 1.
Figure 6:
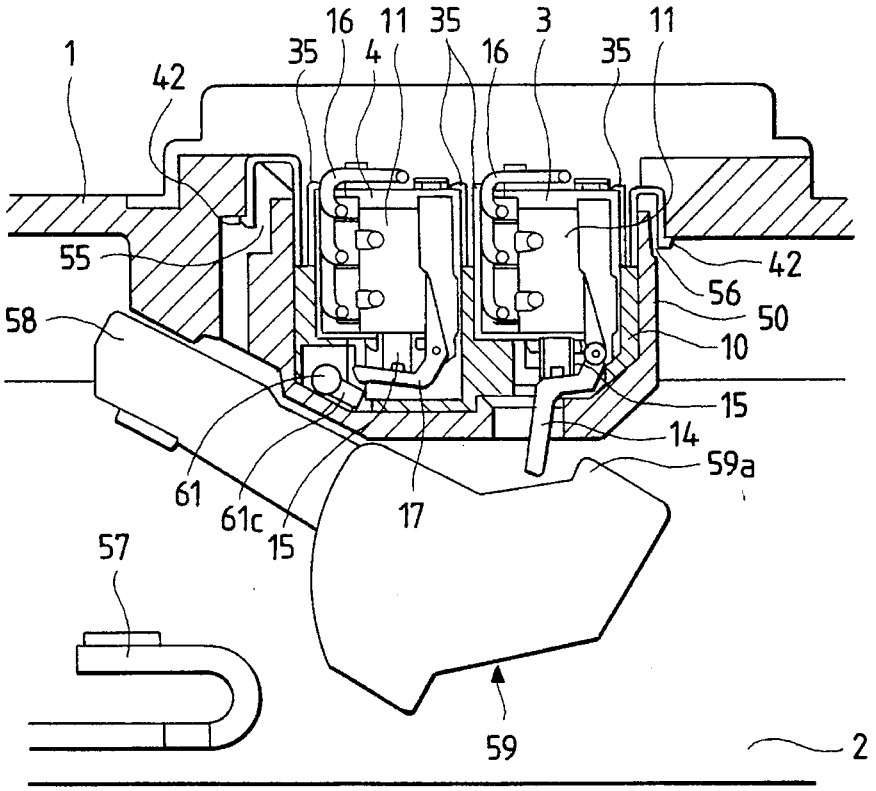
FIG. 6 is a sectional view taken along line A—A in FIG. 5.
Figure 7:
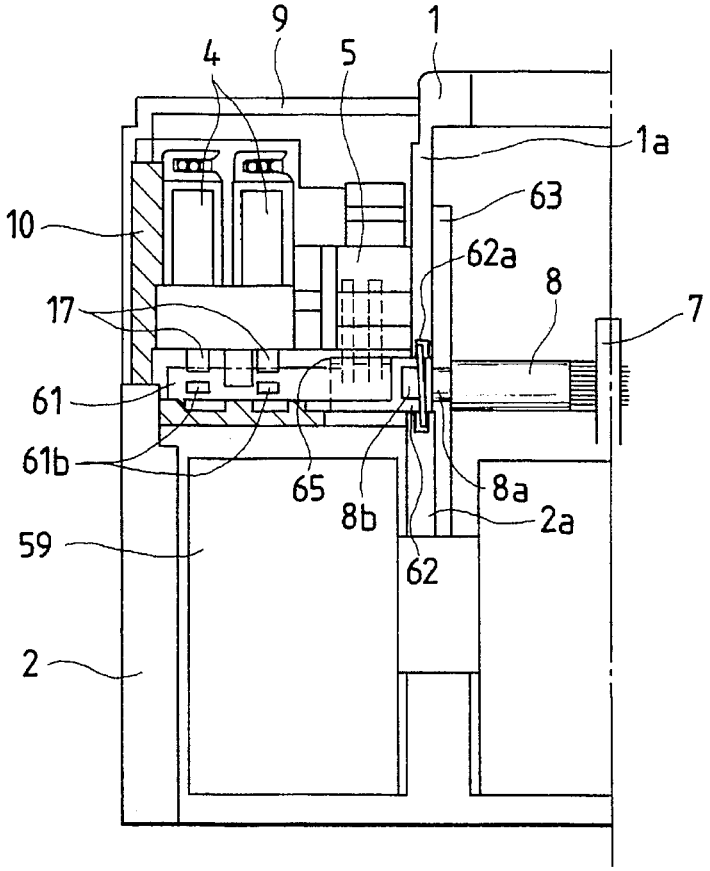
FIG. 7 is a sectional view taken along line B—B in FIG. 5.
Figure 8:
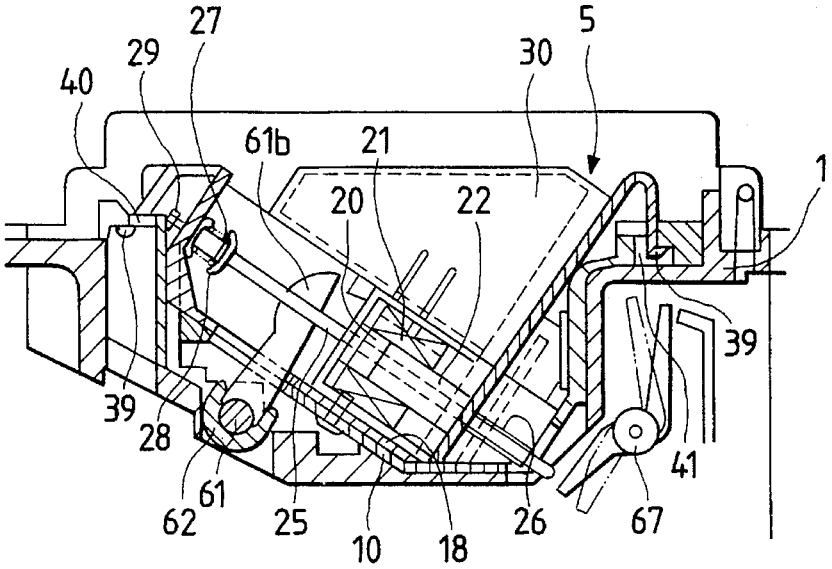
FIG. 8 is a sectional view taken along line C—C in FIG. 5.

FIG. 5 is an enlarged diagram showing an accessory mounting region. FIG. 6 is a sectional view taken along line A—A in FIG. 5. FIG. 7 is a sectional view taken along line B—B in FIG. 5. FIG. 8 is a sectional view taken along line C—C in FIG. 5.

As shown in those figures, the auxiliary switches 3, the alarm switches 4, and the trip unit 5 are each in the form of a cassette, and detachably mounted on a base 10 formed by molding. The base 10 is detachably mounted in a recess formed in the case 1.

The arrangement of those accessories will be described in more detail.

Figure 11:
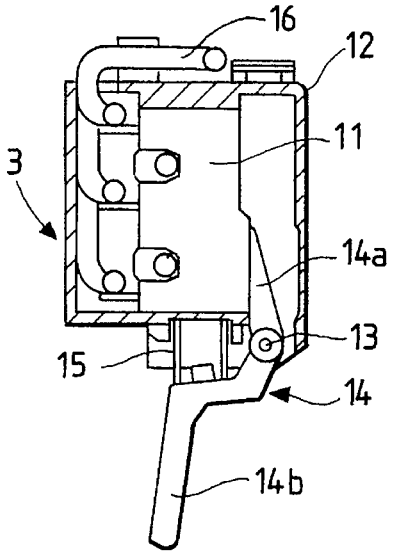
FIG. 11 is a vertical sectional view of an auxiliary switch shown in FIG. 5.

FIG. 11 is a vertical sectional view showing the auxiliary switch 3. The auxiliary switch 3 is in the form of a cassette in which a micro-switch 11 is held in a molded resin case 12. The auxiliary switch 3 is operated with an actuator 14, which is mounted through a pin 13 on the case 12.

The actuator 14 is urged counterclockwise by a back spring 15 inserted between it and the case 12, so that its upper end portion 14*a* depresses a push button (not shown) of the microswitch 11. When the circuit breaker is turned on, the actuator 14 is turned clockwise to release the push button, so that the armature of the microswitch 11 is tripped (described later). In FIG. 11, reference numeral 16 designates lead wires, which are arranged on the upper surface of the case 11 in such a manner that they are extended in a direction perpendicular to the surface of the drawing.

Figure 12:
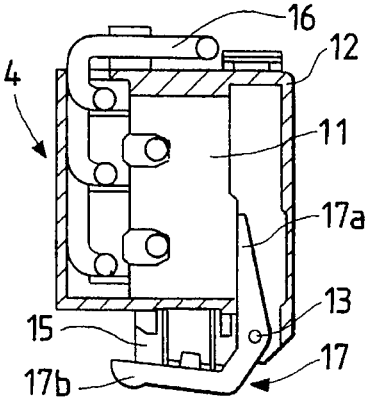
FIG. 12 is a vertical sectional view of an alarm switch shown in FIG. 5.

FIG. 12 is a vertical sectional view showing the alarm switch 4. The structure and the operation of the alarm switch 4 are the same as those of the auxiliary switch 3 except that its actuator 17 is different in configuration from the actuator 14. That is, the components of the alarm switch 4 except the actuator 17 can be used, as they are, to form the auxiliary switch 3. When the circuit breaker is tripped (as described later), the actuator 17 is turned clockwise in FIG. 12, so that its upper end portion 17*a* releases the push button, and therefore the armature of the microswitch 11 is tripped.

Figure 13:
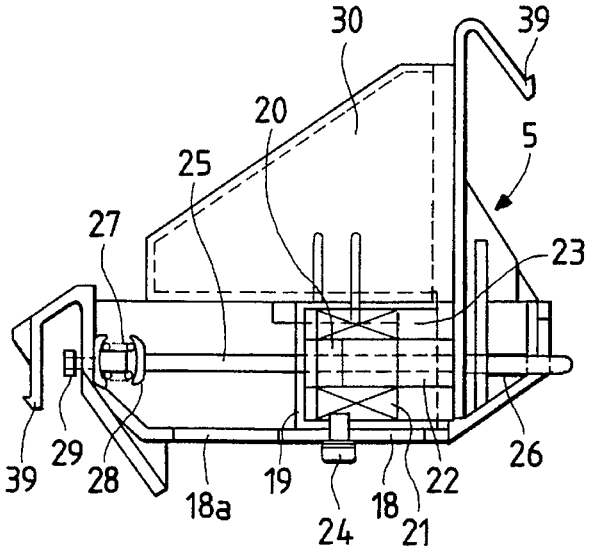
FIG. 13 is a vertical sectional view of the trip unit shown in FIG. 5.

FIG. 13 is a side view of the trip unit 5. The trip unit 5 is also in the form of a cassette in which its components are mounted on a boat-shaped unit base 18. In FIG. 13, reference numeral 19 designates a U-shaped yoke; 20, a stationary iron core coupled to the yoke 20 at the middle; 21, an electro-magnetic coil surrounding the stationary iron core 20; 22, a movable iron core which is movable back and forth with respect to the stationary iron core 20 being guided by a non-magnetic cylinder (not shown) provided inside the electro-magnetic coil 21; and 23, a permanent magnet arranged outside the movable iron core 22 in such a manner that it is adjacent to the electro-magnetic coil 21. The yoke 19 is secured to the unit base 18 with screws 24. The bottom of the unit base 18 has a window 18*a* into which a reset lever (described later) is inserted.

Further in FIG. 13, reference numeral 25 designates a push bar which penetrates the yoke 19, the stationary iron core 20, and the movable iron core 22 along the central axis and is connected to the latter 22; 26, a reset spring which is a compression coil spring inserted between the unit base 18 and the movable iron core 22; 27, a trip spring which is a compression coil spring coupled to the unit base 18 so as to apply a force to the left end of the push bar 25 through a spring receiver 28; 29, an adjusting screw for adjusting the elastic force of the trip spring 27; and 30, a DC source unit for supplying an exciting current to the electro-magnetic coil 21. The DC source unit 30 is made up of a constant voltage type rectifier circuit, and incorporates a polarity switching connector which is coupled to the electro-magnetic coil 21.

The trip unit 5 shown in FIG. 13 may be used as an undervoltage trip unit or a voltage trip unit. In the case where it is used as an undervoltage trip unit, the input side of the DC source unit 30 is connected through a suitable transformer or voltage divider to the main circuit, and the output side is connected to the electro-magnetic coil 21 in such a manner that the magnetic flux thereof coincides with that of the permanent magnet 23 in direction. Hence, the movable iron core 22 is attracted towards the stationary iron core 20 by both the magnetic flux of the electro-magnetic coil 21 and that of the permanent magnet 23, so that the trip spring 27 is energized being compressed through the push bar 25.

When, under this condition, the main circuit voltage decreases to lower than a predetermined value, the magnetic flux of the electro-magnetic coil 21 is reduced; that is, the force of attraction is decreased as a whole. As a result, the movable iron core 22 is moved away from the stationary iron core 20 by the elastic force of the trip spring 27, so that it is moved to the right in FIG. 13 against the reset spring 26. As a result, a trip stroke bar (not show) is struck by the right end of the push bar 25, thus opening the circuit breaker.

In the case where the trip unit 5 is employed as a voltage trip unit, the input side of the DC source unit 30 is connected to an operating circuit, and the output side is connected to the electro-magnetic coil 21 in such a manner that the magnetic flux of the latter is opposite in direction to that of the permanent magnet 23. Thereafter, the adjusting screw 29 is loosened to decrease the elastic force of the trip spring 27 so that the attraction of the movable iron core 22 is achieved by the magnetic flux of the permanent magnet 23 only.

When the electro-magnetic coil 21 is not excited, the movable iron core 22 is attracted towards the stationary iron core 20 by the magnetic flux of the permanent magnet 23, so that the trip spring 27 is energized. When, under this condition, a tripping voltage is applied to the electro-magnetic coil 21, the magnetic flux of the latter 21 cancels that of the permanent magnet 23, so that the movable iron core 22 is released from the attraction. Thus, similarly as in the above-described case, the circuit breaker is opened.

Figure 14:
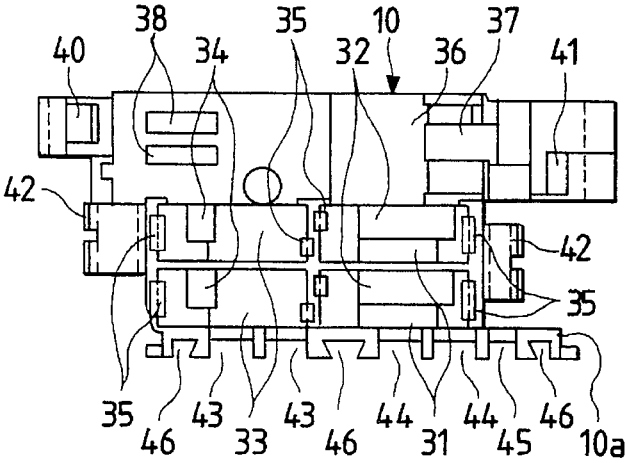
FIG. 14 is a plan view of a base shown in FIG. 5.
Figure 15:
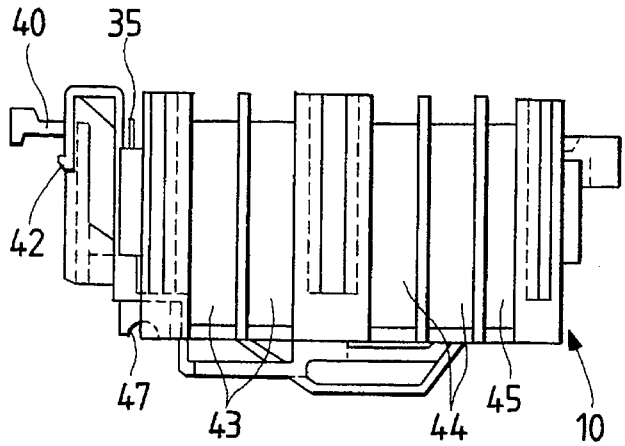
FIG. 15 is a side view of the base shown in FIG. 5.

FIGS. 14 and 15 are a plan view and a side view of the base 10, respectively. In FIGS. 14 and 15, reference numeral 31 designates recesses in which the auxiliary switch 3 is fitted, the recesses 31 having windows 32 in their bottoms, through which the actuators 14 are extended; 33, recesses in which the alarm switches 4 are fitted, the recesses 33 having windows 34 through which the actuators 17 are extended. The recesses 31 and 32 have each a pair of hooks 35 at the front and rear ends which are so raised as to hold the respective switches 3 and 4 (described later).

Further in FIGS. 14 and 15, reference numeral 36 designates a recess in which the trip unit 5 is fitted. The recess 36 has a window 37 in one end portion of the bottom, through which the push bar 25 is extended. In addition, a pair of windows 38 are formed in the other end portion of the bottom in such a manner that they are arranged in the right-to-left direction. The windows 38 are to receive a fork-shaped reset lever (described later). The base 10 has rectangular holes 40 and 41 in front of and at the rear of the recess 36, with which a pair of hooks 39 (FIG. 6) of the unit base 18 of the trip unit 5 are engaged (as described later).

Furthermore, the base 10 has a pair of hooks 42 in front of and at the rear of the recesses 31 and 33, respectively, with which the base 10 is fixedly secured to the cover 1.

The base has a left side wall, in which two grooves 43, two grooves 44, and one groove 45 are formed in such a manner that they are each U-shaped in section and extended downwardly. The lead wires of the alarm switches 4, the auxiliary switches 3, and the trip unit 5 are arranged in those grooves 43, 44 and 45, respectively. In addition, the side wall of the base 10 has dovetail grooves 46 with which a cover plate for retaining the lead wires is engaged.

The base 10 has a groove 47 arcuate in section, which cooperates with the cover 1 to hold an operating shaft (described later) adapted to operate the alarm switch 4.

Figure 16:
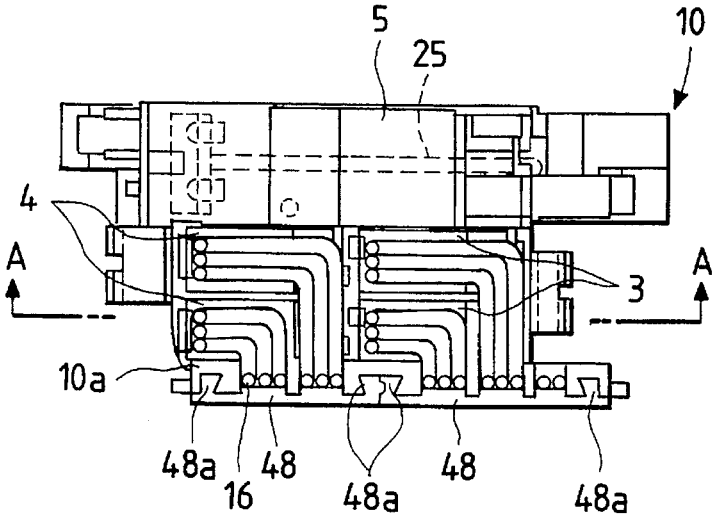
FIG. 16 is a plan view of an accessory module which is formed by mounting the auxiliary switches (FIG. 11), the alarm switches (FIG. 12) and the trip unit (FIG. 13) on the base (FIG. 14)
Figure 17:
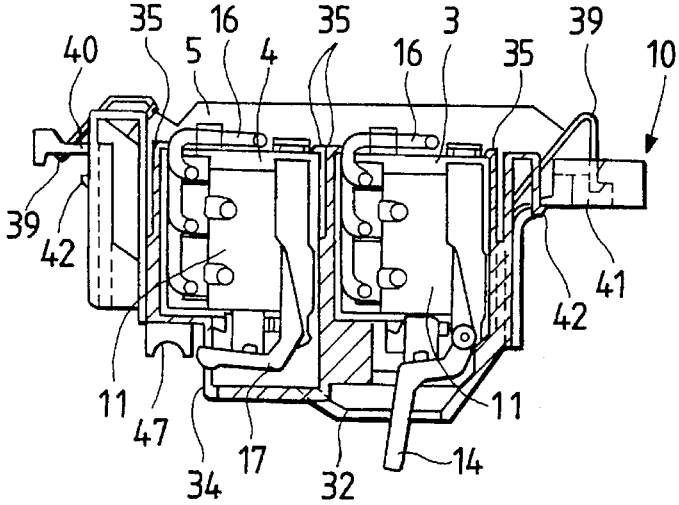
FIG. 17 is a sectional view taken along line A—A in FIG. 16.

FIG. 16 is a plan view showing an accessory module which is provided by mounting the auxiliary switches 3, the alarm switches 4, and the trip unit 5 on the base 10. FIG. 17 is a sectional view taken along line A—A in FIG. 16.

The two alarm switches 4 and the two auxiliary switches 3 are fitted in the recesses 33 and 31 (FIG. 14) while elastically deforming the hooks 35 back and forth, respectively. When the hooks 35 thus deformed are restored, they hold the upper surfaces of those switches 4 and 3 to fixedly secure them in the recesses 33 and 31. The actuators 17 of the alarm switches 4 are extended through the windows 34 forwardly of the base 10, and the actuators 14 of the auxiliary switches 3 are extended through the windows 32 downwardly of the base 10. Those switches 3 and 4 can be readily removed from the base 10 by elastically deforming the hooks 35.

The trip unit 5 is fitted in the recess 36 (FIG. 14) of the base 10. In this operation, the hooks 39 are inserted into the rectangular holes 40 and 41 while being elastically deformed, so that they are engaged with the edges of the rectangular holes 40 and 41 on the rear side of the base 10, so as to fixedly mount the trip unit 5 on the base 10. The push bar 25 is extended through the window 37 (FIG. 14) backwardly of the base 10. The trip unit 5 can be also readily removed from the base 10 by elastically deforming the hooks 39.

The lead wires of the alarm switches 4, the auxiliary switches 3, and the trip unit 5 are arranged in the grooves 43, 44 and 45 of the base 10, respectively, and are retained by the cover plate 48 which is made up of two right and left parts. More specifically, the two right and left parts of the cover plate 48 have protrusions 48*a*. The protrusions 48*a* are press-fitted in the dovetail grooves 46 to fix the cover plate 48 thereby to retain those lead wires.

Figure 18:
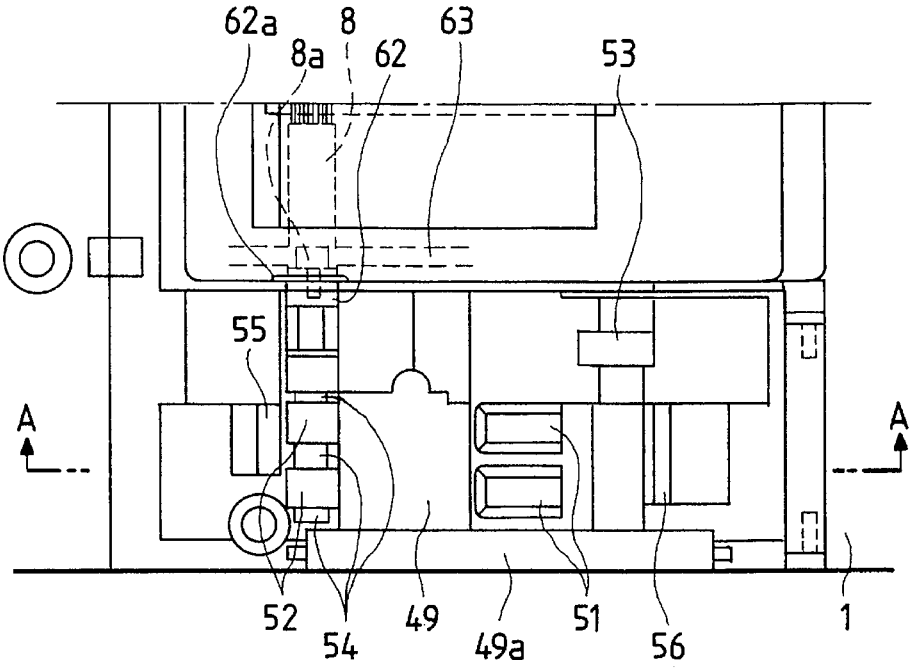
FIG. 18 is a plan view showing a recess formed in the cover shown in FIG. 5.
Figure 19:
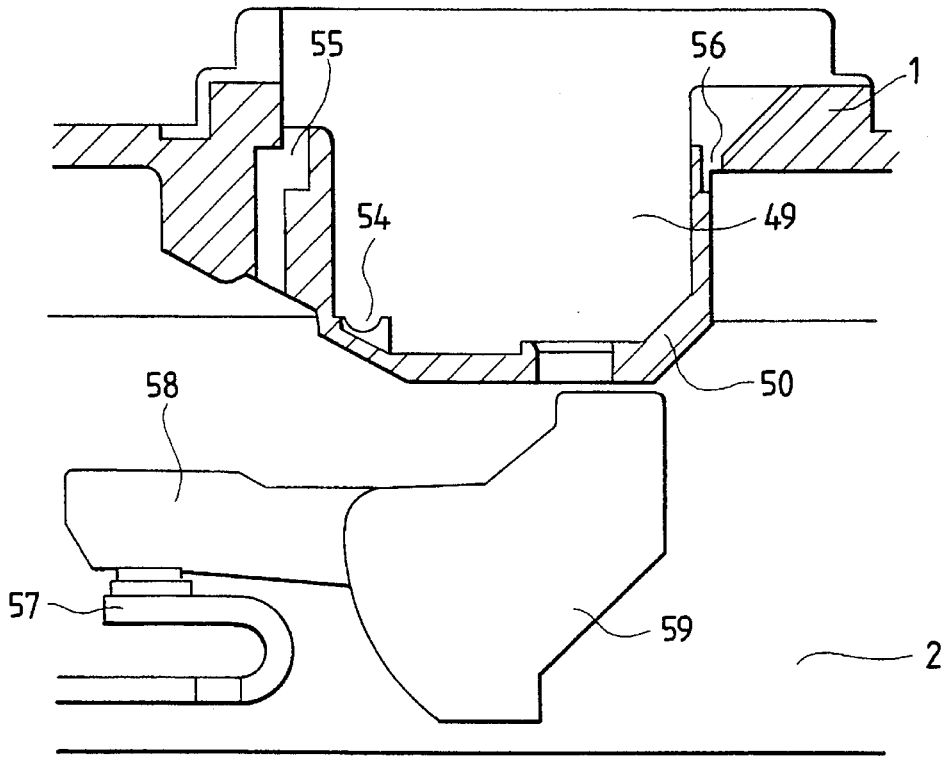
FIG. 19 a sectional view taken along line A—A in FIG. 18.

FIGS. 18 and 19 show a recess 49 of the cover 1 in which the above-described accessory module is mounted. More specifically, FIG. 18 is a plan view showing essential parts of the insulated container from which the auxiliary cover 9 has been removed. FIG. 19 is a sectional view taken along line A—A in FIG. 18.

As shown in FIGS. 18 and 19, the recess 49 is formed on the side of R-phase of the cover 1, and its internal configuration is so made as to meet the external configuration of the base 10. The recess 49 has an opening 49*a* in its side wall which is confronted with the side wall 10*a* (FIG. 14) of the base 10. The recess 49 has a partition wall 50, in which rectangular holes 51, 52 and 53 are formed in alignment with the windows 32, 34 and 37 of the base 10. Furthermore, the partition wall 50 has a groove 54 which is paired with the aforementioned groove 47.

The cover 1 has rectangular holes 55 and 56 on both si of the recess 49 with which the hooks 42 of the base 10 are engaged. In FIG. 19, reference numeral 57 designates an R-phase stationary contact; 58, an R-phase movable contact; and 59, an holder of insulating material which holds the movable contact 58. The holder 59 performs a swinging (opening and closing) operation.

In mounting the accessory module (formed by mounting the accessories on the base 10) on the cover 1, the base 10 is fitted in the recess 49 from above. In this operation, the hooks 42 are pushed into the rectangular holes 55 and 56 while being elastically deformed inwardly. When the base 10 has been fitted in the recess 49, the hooks 42 are restored to engage with the cover 1 as shown in FIG. 6, so that the base 10 is fixedly secured to the cover 1. Thereafter, the arms 9*c* are opened to fit the pins 9*a* into the bearing holes 60 (FIG. 5) of the cover 1; that is, the auxiliary cover 9 is coupled to the cover 1.

Figure 20:
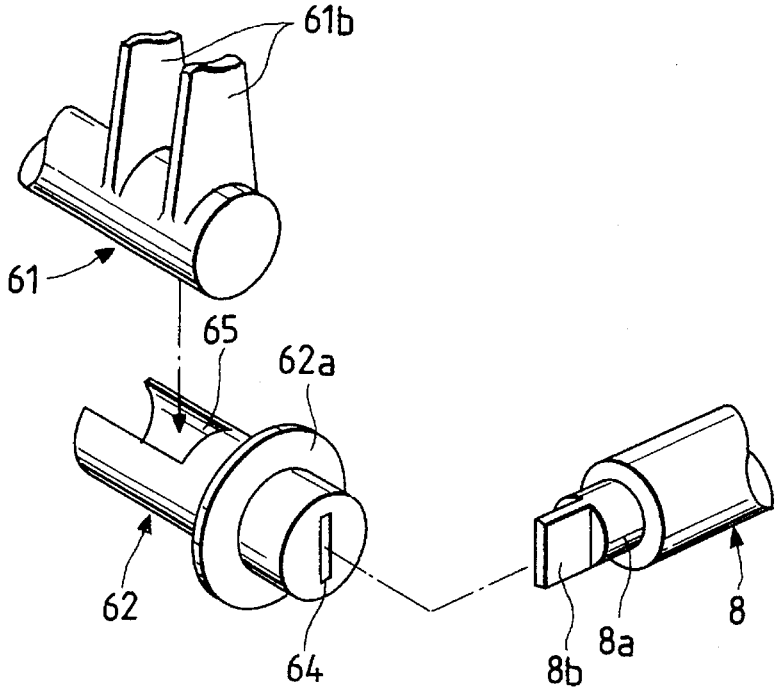
FIG. 20 is an enlarged diagram showing essential components in FIG. 7.

In FIGS. 6 and 7, reference numeral 61 designates an operating shaft for operating the alarm switches 4 and to reset the trip unit 5; and 62, an inter-phase piece interposed between the operating shaft 61 and the latch pin 8. FIG. 20 is an enlarged perspective view showing parts of the operating shaft 61 and the inter-phase piece 62.

As shown in FIG. 7, the latch 7 is fixedly mounted on the serrated middle portion of the latch pin 8. The latch pin 8 is rotatably mounted on side plates 63 through its two end portions 8*a* smaller in diameter (only one end portion 8*a* shown which is on the side of R-phase). As shown in FIG. 20, a plate-shaped coupling piece 8*b* is extended from the end face of the small diameter end portion 8*a*.

The inter-phase piece 62 is in the form of a resin-molded rod. The inter-phase piece 62 has a slit 64 in one end portion which is extended axially so as to engage with the coupling piece 8*a*, and an annular-flange-shaped barrier 62 is formed on the outer cylindrical surface of the one end portion. The inter-phase piece 62 has a U-groove 65 in the other end portion which is engaged with the operating shaft 61.

Before the switching mechanism 6 is mounted in the casing 2, the inter-phase piece 62 is engaged with the latch pin 8 so that the former 62 is turned together with the latter 8.

On the other hand, as shown in FIG. 7 semi-circular recesses for receiving the inter-phase piece 62 and semi-circular grooves for receiving the barrier 62*a* are formed in the inter-phase partition walls 2*a* and 1*a* of the casing 2 and the cover 1. Therefore, when the switching mechanism 6 is mounted in the casing 2, the inter-phase piece 62 is inserted into the above-described recesses and grooves. Thereafter, the cover 1 is mounted on the casing 2, and therefore the inter-phase partition walls 1*a* and 2*a* prevent the inter-phase piece from coming off the latch pin 8.

Figure 21A:
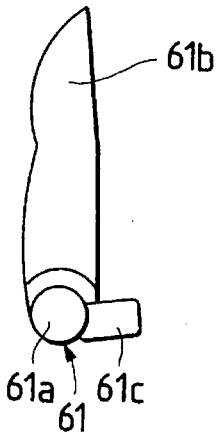
FIGS. 21(A), 21(B) and 21(C) are a left side view, a front view, and a right side view of an operating shaft shown in FIG. 7, respectively.
Figure 21B:
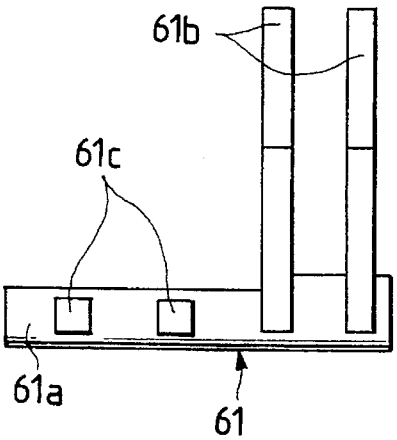
Figure 21C:
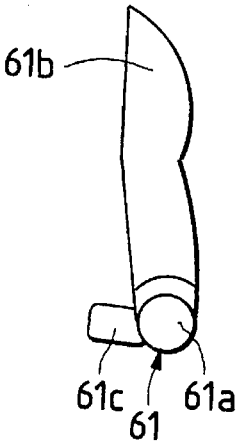

FIGS. 21(A) through 21(C) show the operating shaft 61, in which FIGS. 21(A), 21(B) and 21(C) are a left side view, a front view, and a right side view of the operating shaft 61, respectively. As shown in FIGS. 21(A) through 21(C), the operating shaft 61 comprises a cylindrical shaft 61*a* which is large enough in diameter to be fitted in the groove 64 of the inter-phase piece 62; right and left reset levers 61*b* arranged like a fork which are extended from one end portion of the cylindrical shaft 61*a* to reset the trip unit 5; and operating levers 61*c* which are extended from the other end portion of the cylindrical shaft 61*a* to operate the two right and left alarm switches 4, respectively.

The operating shaft 61 is supported as follows: Before the base 10 is mounted on the cover 1, the one end portion of the operating shaft 61 from which the reset lever 61*b* are extended is fitted in the groove 64 of the inter-phase piece 62, and the other end portion is fitted in the groove 54 (FIG. 19) formed in the recess 49. As a result, the reset levers 61*b* are prevented from being turned, and the operating shaft 61 is coupled to the inter-phase piece 61 and accordingly to the latch pin 8. Thereafter, the aforementioned accessory module is mounted above the operating shaft 61; that is, as shown in FIG. 6, the operating shaft 61 is rotatably held in the groove 47 (FIG. 15) of the base 10. More specifically, the end portion of the cylindrical shaft 61*a* which is fitted into the inter-phase piece 62 is elliptic in section as shown in the part (C) of FIG. 21, so that it can be engaged with or disengaged from the groove 64 with ease.

As is well known in the art, when the circuit breaker is in "on" state or in "off" state, the latch 7 is locked to a latch receiver (not shown). When, with the circuit breaker is in "on" state, an undercurrent trip unit (not shown) or the trip unit 5 is operated to strike a trip mechanism to release the latch 7, then the latter 7 is turned together with the latch pin 8 by the force of a switching (opening and closing) spring (not shown) which has been energized in advance, so that the elastic action of the switching spring on a toggle link (not show) is reversed, to turn the holder 59. As a result, the movable contact 58 held by the holder 59 is moved away from the stationary contact as shown in FIG. 6 (a trip operation).

When the latch 7 is locked in the above-described manner, the operating levers 61*c* are positioned as shown in FIG. 6 with respect to the actuators 17 of the alarm switches 4. Therefore, when the circuit breaker performs the above-described trip operation so that the operating shaft 61 together with the latch pin 8 is turned counterclockwise in the figure, the operating levers 61*c* act on the lower end portions 17*b* of the actuators 17 to turn the latter clockwise. As a result, the alarm switches 4 output trip signals through the lead wires 16.

The reset levers 61*b* of the operating shaft 61 are inserted into the trip unit 5 through the windows 38 (FIG. 14) of the base 10 and the window 18*a* of the unit base 18 when the accessory module is mounted on the cover 1. The reset levers 61*b* are set both sides of the push bar 25, and confronted with the spring receiver 28 as shown in FIG. 8.

Figure 9:
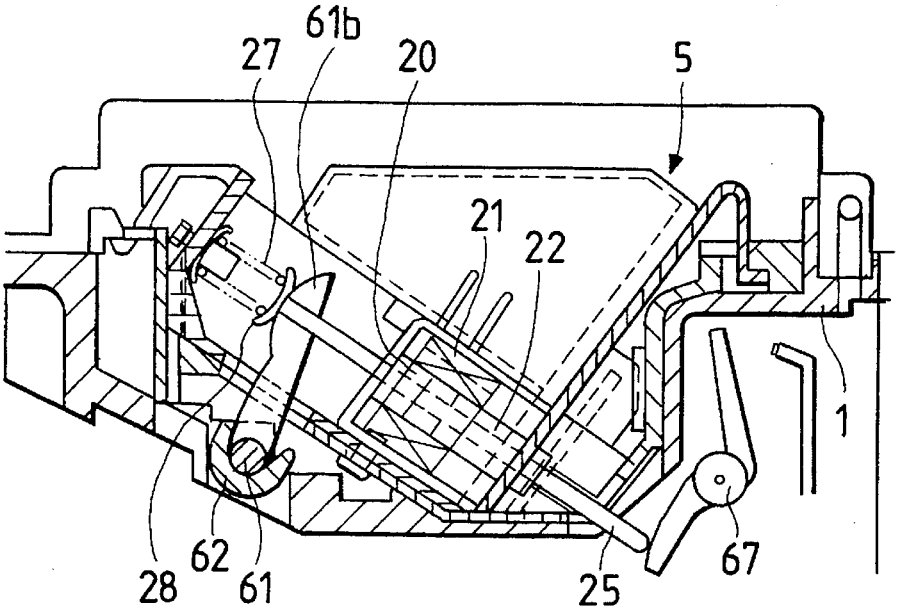
FIG. 9 is a diagram showing a state of a trip unit (FIG. 8) during the trip operation of the circuit breaker.

When the trip unit 5 operates so that the movable iron core 22 is released from the stationary iron core 20, the push bar 25 is pushed out to strike a trip cross bar 67 as shown in FIG. 9, so that the latter 67 is turned counterclockwise in FIG. 9. As a result, the latch 7 is released from being locked by the latch receiver, and therefore the circuit breaker is opened.

Figure 10:
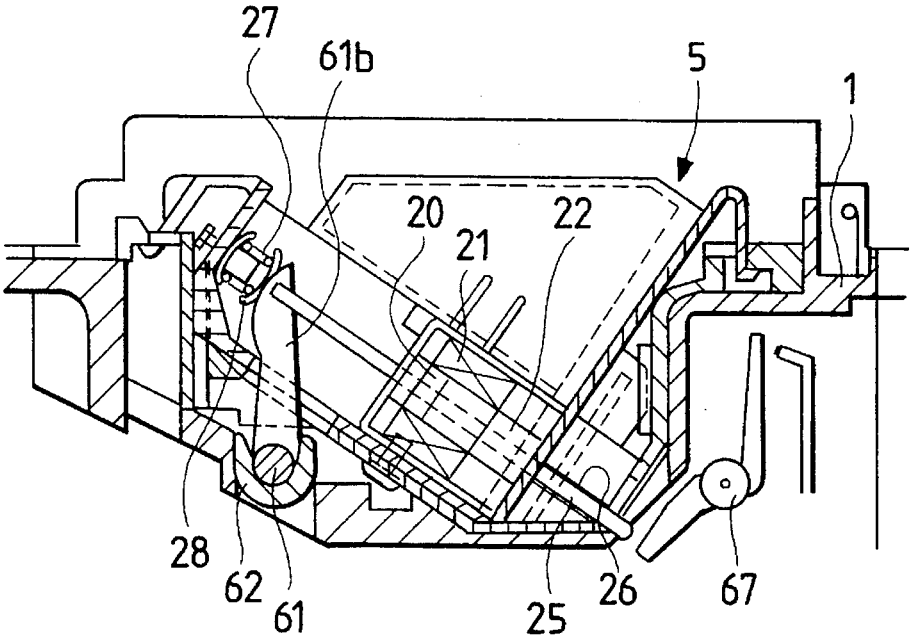
FIG. 10 is a diagram showing a state of the trip unit at the end of the trip operation of the circuit breaker.

During the trip operation of the circuit breaker, the operating shaft 61 is turned counterclockwise being driven by the latch pin 8, so that the reset levers 61*b* integral with the operating shaft 61 are moved in a direction opposite to the direction of stretch of the trip spring 27 to abut against the spring receiver 28 as shown in FIG. 9. As the operating shaft 61 is further turned, the reset levers 61*b* push back the trip spring 27 through the spring receiver 28, and, at the end of the trip operation, it compresses the trip spring 27 as shown in FIG. 10. Hence, the movable iron core 22 is brought into contact with the stationary iron core 20 again by the elastic force of the reset spring 26. Therefore, when it is detected that, at this time instant, the circuit voltage is restored to the predetermined value (in the case of the undervoltage trip operation), or the operating voltage is zero (in the case of the voltage trip operation), then the trip unit 5 is reset.

As was described above, FIG. 10 shows a trip completion state in which the latch 7 is released and turned to the end. Mounting the accessory module including the trip unit 5 is carried out after the trip completion state 10 has been established. In this case, the reset levers 61*b* are held vertical as shown in FIG. 10, so that they can readily go into the trip unit 5 through the windows 38 of the base 10 and the window 18*a* of the unit base 18 which are inserted from above.

It is assumed that the trip unit 5 is an undervoltage trip unit, and, when it is mounted, the trip spring 27 has been stretched. In this case, the spring receiver 28 abuts against the curved surfaces of the end portions of the reset levers 61*b*, so that the trip spring 27 is pushed in until it is reset as shown in FIG. 10.

In order to reset the circuit breaker body which is in the trip completion state, an operating handle (not shown) is turned to a reset position manually or electrically so that the latch 7 is turned clockwise in the figure until it is engaged with the latch receiver. However, if, in this operation, the movable iron core 22 is not attracted yet, then the reset levers 61*b* are moved away from the spring receiver 28 with the reset motion of the latch 7, and accordingly the push bar 25 is pushed out again, to turn the trip cross bar 67, thus obstructing the engagement of the latch 7.

That is, when the trip unit 5 is not in steady state (in which, in the case of the undervoltage trip operation, the circuit voltage is at the predetermined value, and in the case of the voltage trip operation, the operating voltage is zero), then the latch 7 cannot be locked; that is, the circuit breaker body cannot be reset. This is a considerable advantage of the circuit breaker of the invention in which the trip unit 5 is reset with the operating shaft 61 coupled to the latch pin 8.

A circuit breaker is known in the art in which the reset lever of the trip unit is driven by the movable contact which has moved away from the stationary contact at the time of trip. In this conventional circuit breaker, even if the trip unit is not in the above-described steady state, the circuit breaker body can be reset when the movable contact is at the open position, because, in this case, the trip spring is bound in operation.

Hence, under this condition, the "on" operation of the circuit breaker can be effected immediately. However, this operation suffers from the following problems: That is, when the "on" operation of the circuit breaker is effected, the movable contact is moved from the open position to the "on" position. As the movable contact is moved in this way, the trip spring is gradually released. Therefore, when the movable contact is moved to a certain position, the trip unit is operated to permit the trip operation of the circuit breaker. As a result, during the "on" operation of the circuit breaker, the movable contact is abruptly returned, thus applying a great impact to the switching mechanism, which may damage the latter.

Furthermore, if the reset levers are operated by using the opening motion of the movable contact, then at the time of trip the reset mechanism of the trip unit is greatly shocked, and it may therefore be damaged. On the other hand, the circuit breaker of the invention is free from the above-described difficulty, because in the circuit breaker of the invention, the trip unit 5 is reset in association with the moderate reset operation of the circuit breaker body which is performed manually or electrically.

As shown in FIG. 6, the lower end portion 14*b* of each of the actuators 14 of the auxiliary switches 3 is confronted with an operating protrusion 59*a* formed on the upper end portion of the holder 59. When, in FIG. 6, the movable contact 58 is moved to close its contact means, the holder 59 is turned counterclockwise in FIG. 6, so that the operating protrusion 59*a* turns the actuator 14 clockwise, to open a push button (not shown) of the microswitch 11.

When the movable contact 58 is moved to open the contact means as shown in FIG. 6, the actuator 14 is restored by the elastic force of the back spring 15, to push the push button to operate the microswitch 11. As a result, the auxiliary switch 3 outputs a switching signal which is supplied outside through the lead wires 16.

Figure 22:
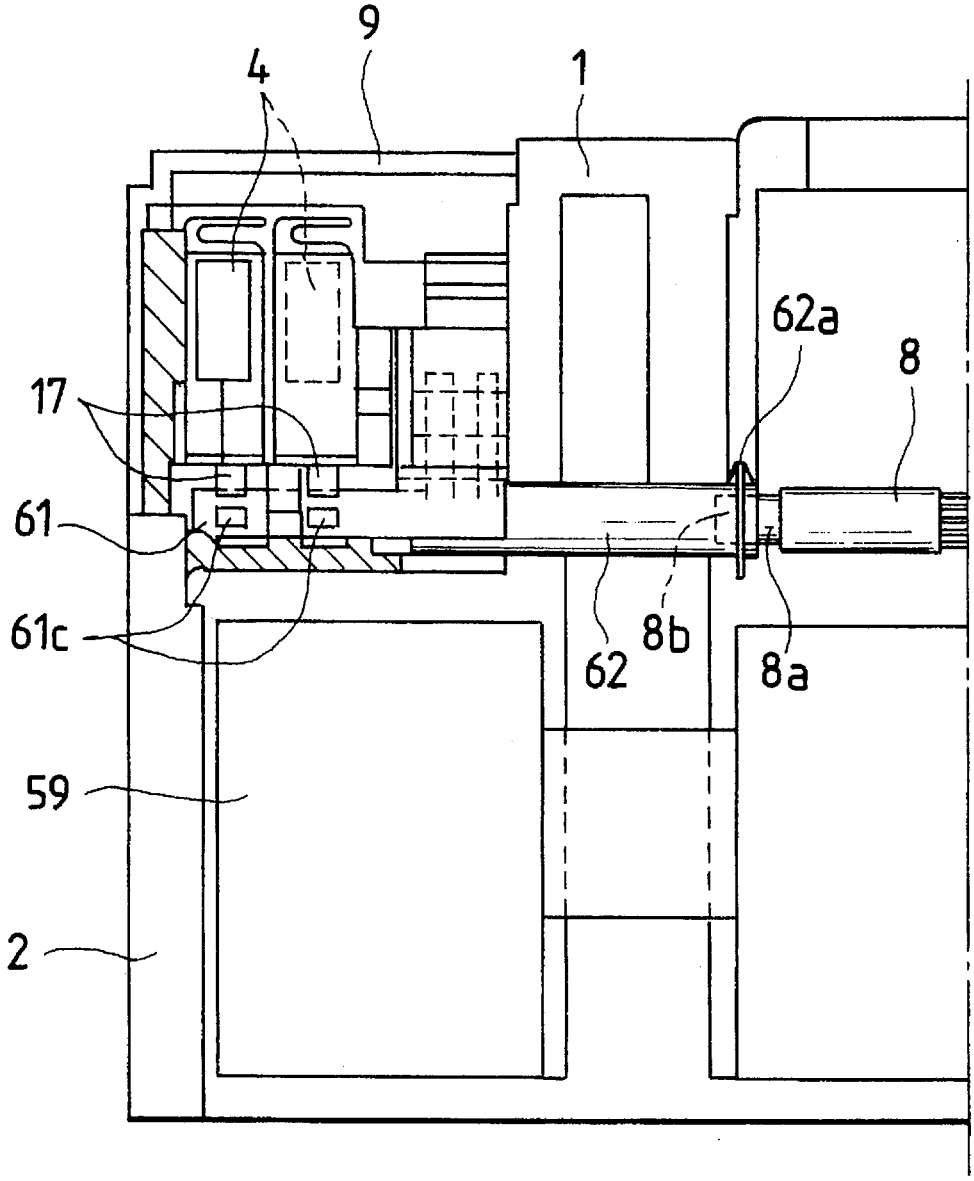
FIG. 22 is a diagram showing the arrangement of a large circuit breaker, corresponding to FIG. 7.

FIG. 22 is a sectional view (corresponding to FIG. 7) of a circuit breaker (for instance 800 A frame) which is larger in capacity than the circuit breaker (for instance 400 A frame) shown in FIGS. 5 through 7. The circuit breaker shown in FIG. 22 is larger in inter-phase distance than the one shown in FIG. 7; however, the former is equal to the latter in the arrangement of the accessory module and the operating shaft 61. Therefore, the circuit breaker of FIG. 22 can be obtained by modifying the circuit breaker of FIG. 7 in such a manner that it employs an inter-phase piece 62 which is larger both in length and in diameter in proportion to the increase of the inter-phase distance.

Figure 23:
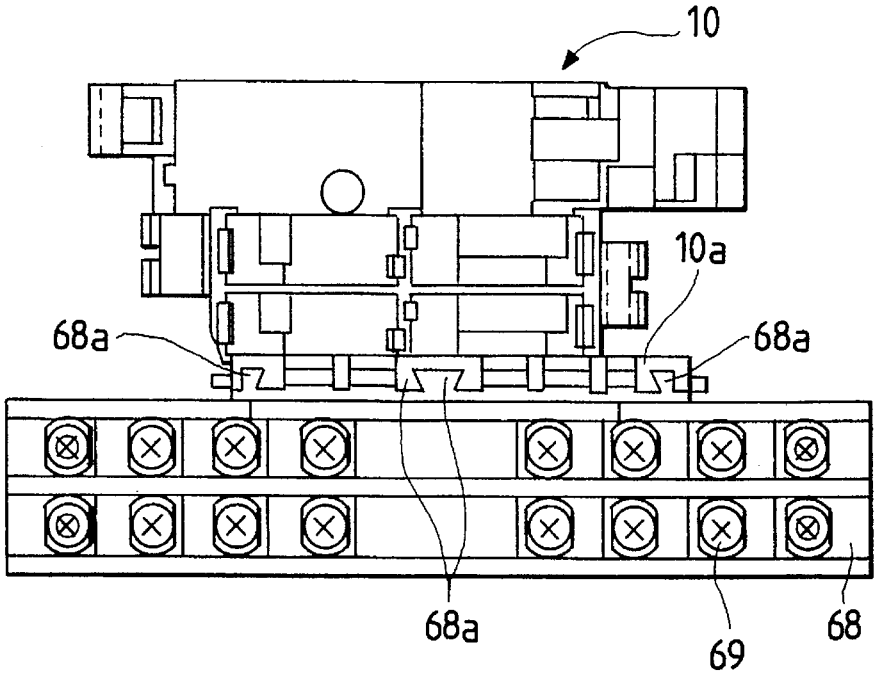
FIGS. 23 and 24 are a plan view and a side view of the base shown in FIG. 14 which is equipped with a terminal board.
Figure 24:
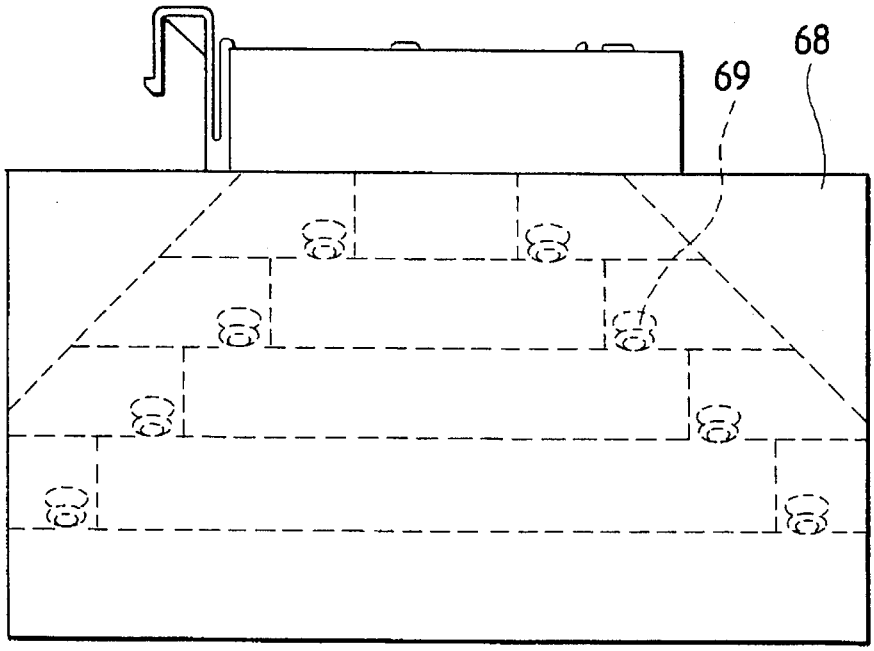
Figure 25:
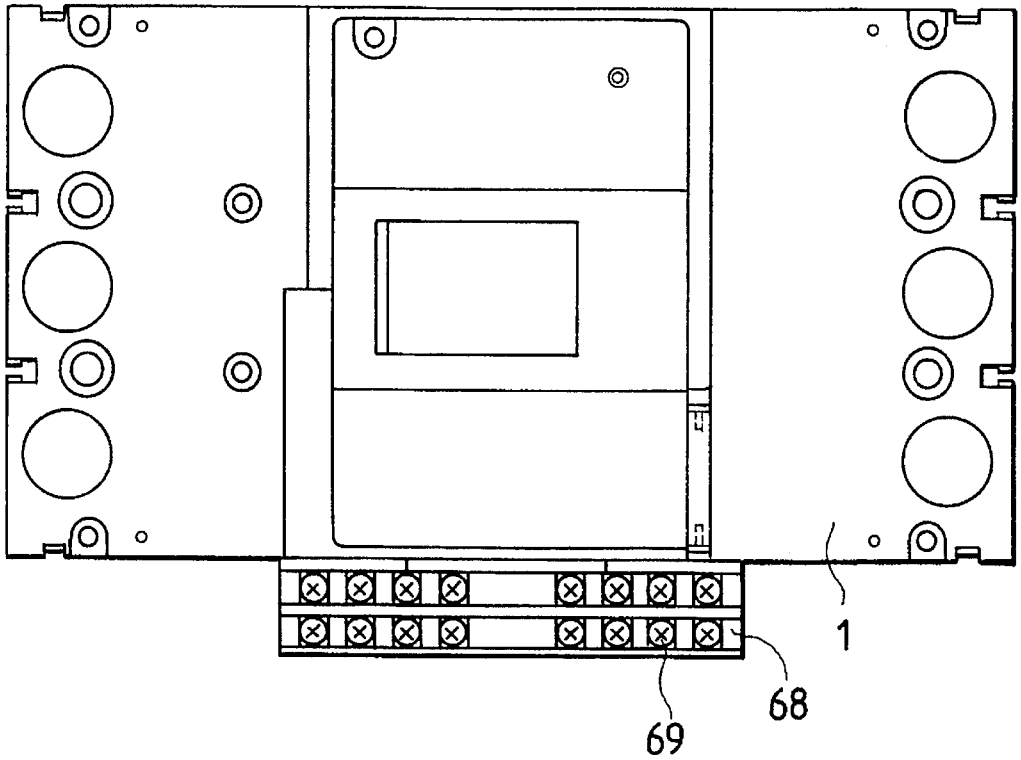
FIGS. 25 and 26 are a plan view and a side view, respectively, showing the circuit breaker with the terminal board.
Figure 26:
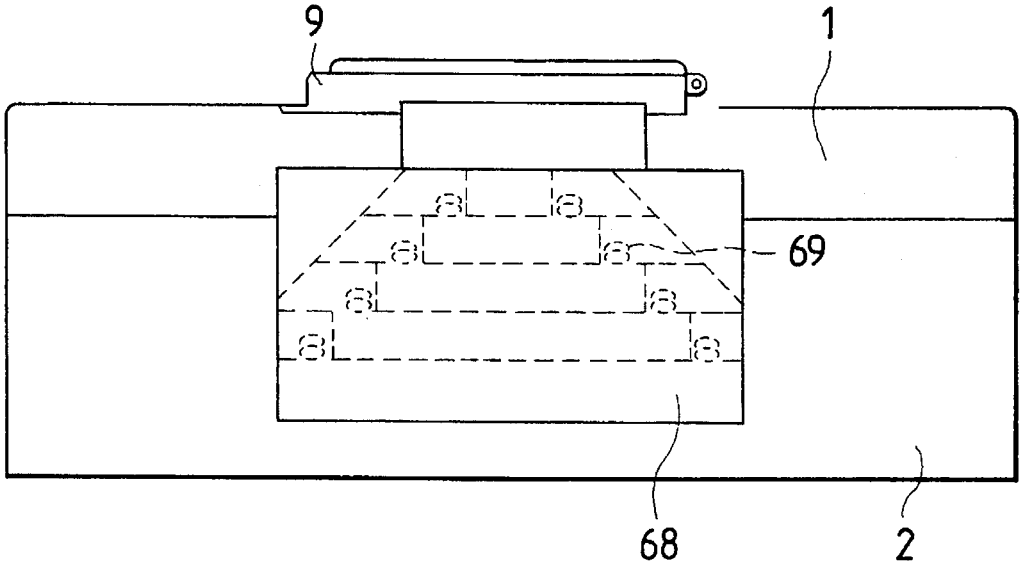

FIGS. 23 and 24 are a plan view and a side view, respectively, showing the base 10 which employs a terminal board 68 instead of the cover plate 48 (FIG. 16). FIGS. 25 and 26 are a plan view and a side vide of another example of the circuit breaker, respectively, which is made up of the base 10 having the terminal board 68.

The side wall of the terminal board 68 has protrusions 68*a* which are similar in configuration to those of the cover plate 48. The protrusions 68*a* of the terminal board 68 are inserted into the dovetail grooves 46 (FIG. 14) of the base 10. The lead wires in the grooves 43, 44 and 45 are led to the rear side of the terminal board body, where they are connected to metal terminals (not shown) into which terminals screws 69 are screwed. As is apparent from the above description, by selectively using the cover plate 48 and the terminal board 68, one and the same the circuit breaker body can be used to form a circuit breaker in which the lead wires are laid (as shown in FIG. 1), and a circuit breaker in which the terminal board is employed (as shown In FIG. 25).

Figure 27:
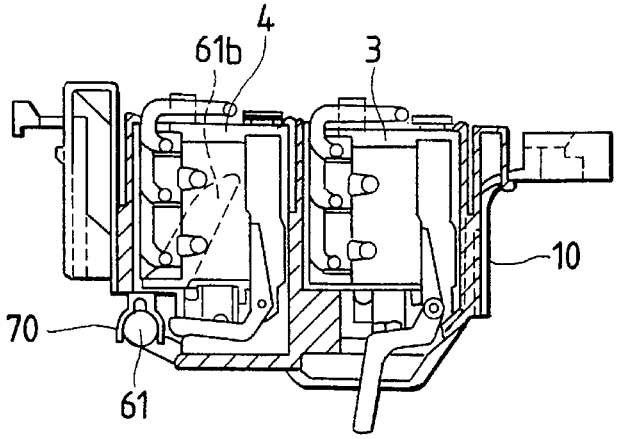
FIGS. 27 and 28 are a vertical sectional view and a front view, respectively, showing an accessory module with its operating shaft held by the base.
Figure 28:
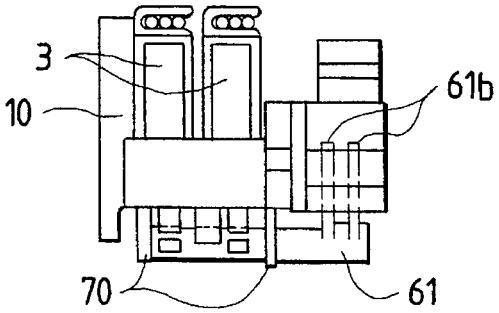

FIGS. 27 and 28 are a side view and a front view, respectively, showing one modification of the accessory module. In the modification, U-shaped clips 70 are formed on the rear side of the base 10, and the operating shaft 61 is held by the U-shaped clips 70. More specifically, the clips 70, as shown in FIG. 28, are positioned at both sides of the groove 47 (FIG. 17) which supports the operating shaft 61, and are integral with the base 10. The clips 70 thus provided hold the operating shaft 61 elastically.

As was described before, the operating shaft 61 is coupled through the inter-phase piece 62 to the latch pin 8 before the mounting of the accessory module. However, sometimes the operating shaft may be lost, or it may be forgotten to couple the operating shaft to the latch pin 8 through the inter-phase piece 62. This problem may be solved by employing the clips 70. That is, with the clips 70, the operating shaft 61 is kept coupled to the base 10 at all times, and therefore when the accessory module is mounted on the circuit breaker, the operating shaft 61 is automatically inserted into the cover 1.

As was described above, in the embodiment of the invention, the accessory module is formed by mounting the two auxiliary switches 3, two alarm switches 4, and one trip unit 5 on the common base 10, and the accessory module thus formed is detachably mounted on the cover 1 of the circuit breaker.

Hence, the accessories can be mounted or demounted as one unit, and after the accessory module is removed from the cover 1, the combination of the accessories may be changed, or other accessories may be added to them. The embodiment has been described with reference to the case where the maximum number of accessories are mounted on the base 10; however, it is not always necessary to mount the accessories in all of the recesses 31, 33 and 36; that is, the number of accessories can be adjusted according to a given specification.

Owing to the employment of the base 10, the wiring of the accessories can be handled only in the accessory module. In the case of the accessory module with the terminal board, the wiring can be achieved with ease.

Furthermore, in the above-described embodiment, the trip unit 5 is reset with the operating shaft 61 coupled to the latch pin 8. Therefore, if the trip unit 5 is not in steady state, then the circuit breaker body is not reset, and accordingly the succeeding "on" operation is not carried out. Hence, the embodiment is free from the difficulty that, as in the case where the trip unit is reset by the opening motion of the movable contact, during the "on" operation of the circuit breaker the movable contact is abruptly returned to damage the switching mechanism, and an impact force is applied to the reset mechanism of the trip unit to damage it.

In the above-described embodiment, the alarm switch 4 is arranged adjacent to the trip unit 5, and therefore the alarm switch 4 also can be operated simultaneously with one and the same operating shaft 61; that is, the circuit breaker is simple in arrangement as much. Furthermore, the auxiliary switch 3 is positioned behind the alarm switch 4, and is operated with the holder 59 holding the movable contact 58. That is, the accessories are reasonably arranged as a whole.

Even in the case where the base 10 is not used, and the accessories are mounted directly on the cover 1, the above-described layout of the accessories may be employed with the same advantages.

Figure 29:
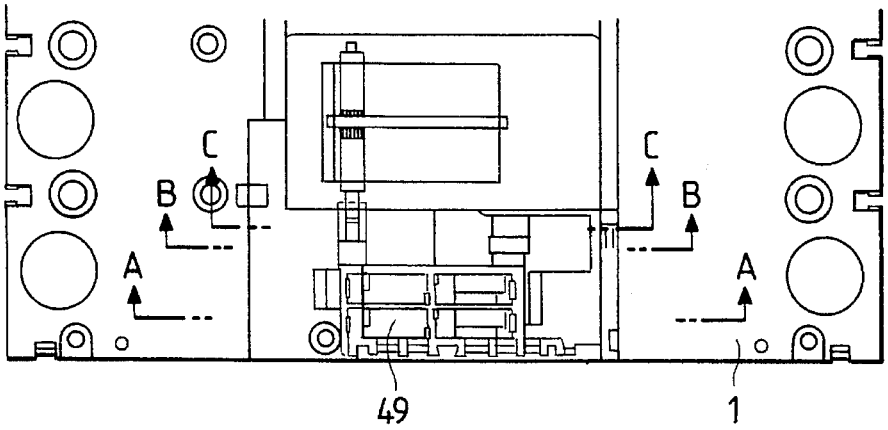
FIG. 29 is a plan view of a circuit breaker in which accessories are mounted directly on the cover.
Figure 30:
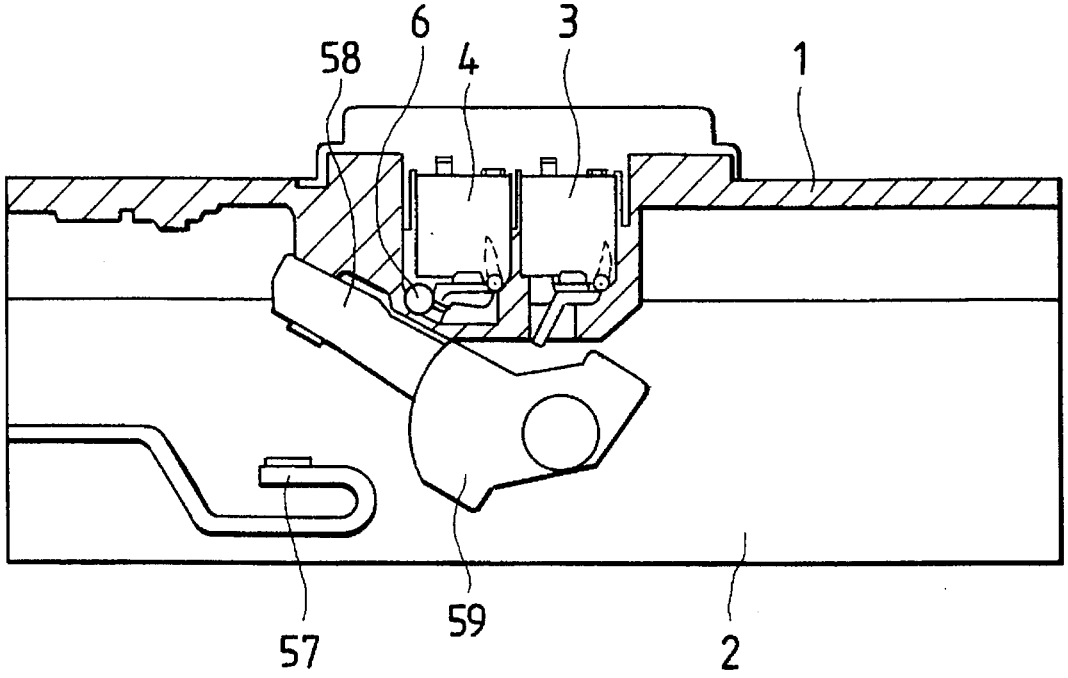
FIG. 30 is a sectional view taken along line A—A in FIG. 29.
Figure 31:
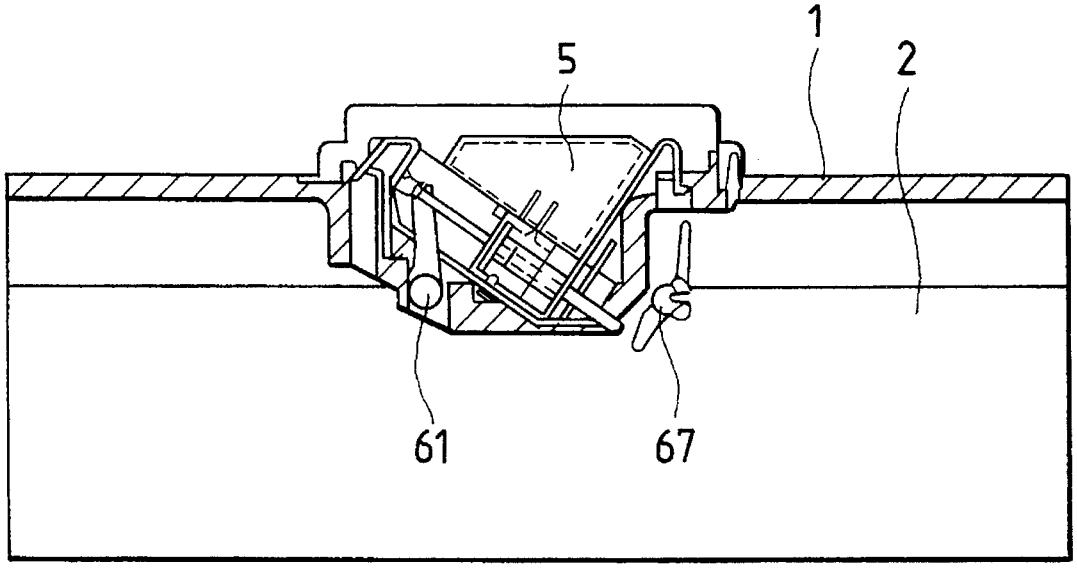
FIG. 31 is a sectional view taken along line B—B in FIG. 29.
Figure 32:
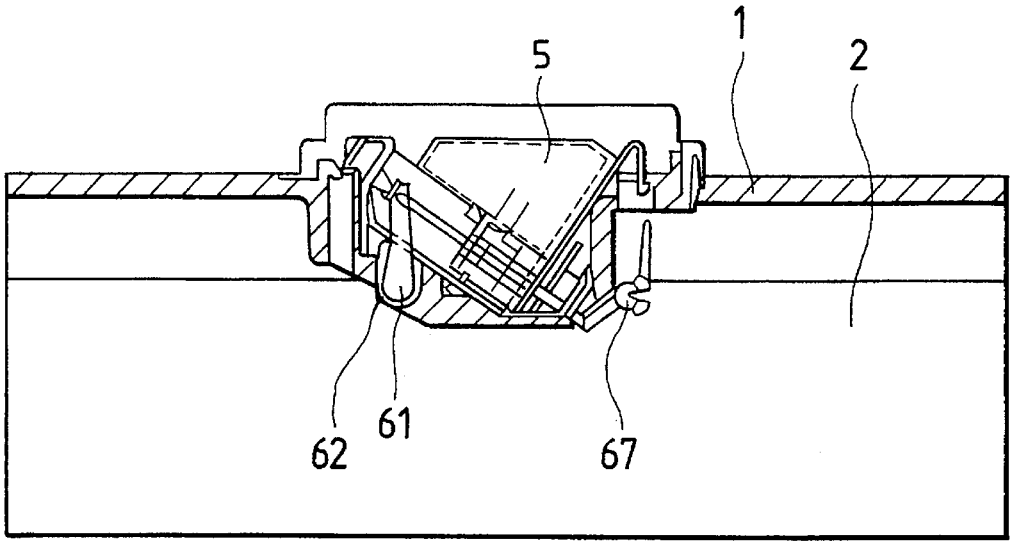
FIG. 32 is a sectional view taken along line C—C in FIG. 29.

FIG. 29 is a plan view of a cover of another example of the circuit breaker which is so designed that no base is used, and the accessories are mounted directly on the cover. FIG. 30 is a sectional view taken along line A—A in FIG. 29, showing the cover on which the accessories are mounted. FIG. 31 is a sectional view taken along line B—B in FIG. 29, and FIG. 32 is also a sectional view taken along line C—C in FIG. 29.

Figure 33:
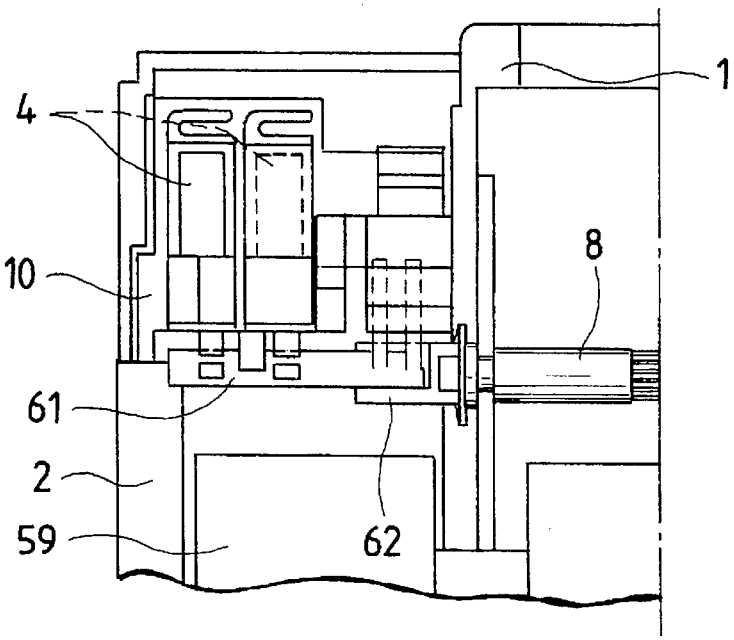
FIG. 33 is a sectional view showing the casing on which the accessory module is mounted, corresponding to FIG. 7.

In the case where the base 10 is employed, it may be mounted on the casing 2. FIG. 33 shows the arrangement of essential parts of the circuit breaker with the base 10 mounted on the casing 2. In the circuit breaker, the end portion of the operating shaft 61, which is on the side of the alarm switch 4, is supported on the casing 2 as shown in FIG. 33.

In a circuit breaker in which its accessories are built in the casing, those accessories are isolated from outside by the cover. Therefore, in the case where the circuit breaker is in the circuit board, the user cannot mount the accessories on it or demount them from it On the other hand, the above-described embodiment, the circuit breaker in which the accessories are detachably mounted in the recesses of the cover with the aid of the base is advantageous in that mounting or demounting of the accessories can be achieved even if the circuit breaker is in the circuit board. However, when the accessories are mounted on or demounted from the circuit breaker body, the latter may suffer from the following difficulties depending on its conditions:

It is dangerous at all times to perform the accessory mounting or demounting operation when the circuit breaker is in "on" state. Even when the circuit breaker is in "off" state, the following trouble may occur: If the user touches a part of the trip mechanism during while mounting or demounting an accessory, then the circuit breaker trips. In this case, the switching mechanism, being operated in the opposite direction, may injure his finger. Especially the mounting of the undervoltage trip unit is dangerous. That is, the undervoltage trip unit cannot be held reset with no voltage, and therefore the circuit breaker is tripped simultaneously when the undervoltage trip unit is mounted.

If, irrespective of the "on" and "off" states of the circuit breaker, the alarm switch or the auxiliary switch is removed from the circuit breaker and the latter is left as it is, then even when the circuit breaker is accidentally tripped during use, no necessary signals are provided, thus adversely affecting the control operation.

In order to eliminate those difficulties, the circuit breaker should be so designed that the mounting and demounting of the accessories is permitted only when the circuit breaker is in "trip" state.

That is, the circuit breaker should be so designed that, when the circuit breaker is both in "on" state and in "off" state, it is inhibited to mount the base on which the accessories have been mounted on the cover or to demount it therefrom, and in addition it is inhibited to mount the accessories on the base which has been mounted on the cover, or to demount the accessories from the base.

When the circuit breaker is in "trip" state, it is safe being turned off. Even if the user touches the trip unit, no trip operation is started, and the removal of the alarm switch or the auxiliary switch will cause no troubles.

FIGS. 34 through 38 show the circuit breaker which is so designed as to meet the above-described requirements. FIG.

Figures 35A, 35B, 35C:
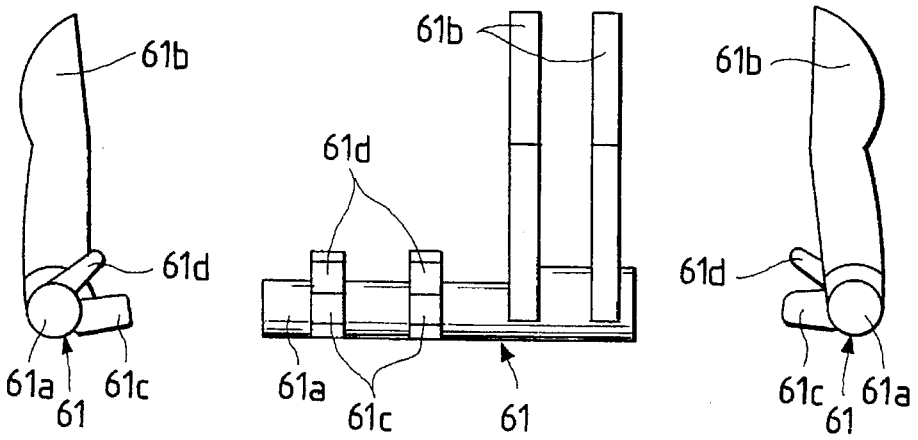
FIGS. 35(A), 35(B) and 35(C) are a left side view, a front view, and a right side view of an operating shaft in the mechanism with which the mounting or demounting of the accessory or accessories is permitted only when the circuit breaker is in "trip" state, respectively.
Figure 36:
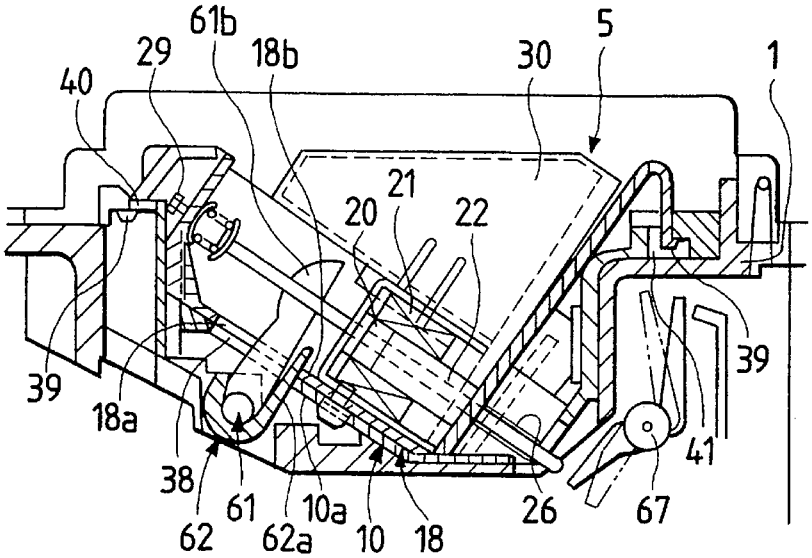
FIG. 36 is a sectional view of a trip unit in the mechanism with which the mounting or demounting of the accessory or accessories is permitted only when the circuit breaker is in "trip" state.
Figure 37:
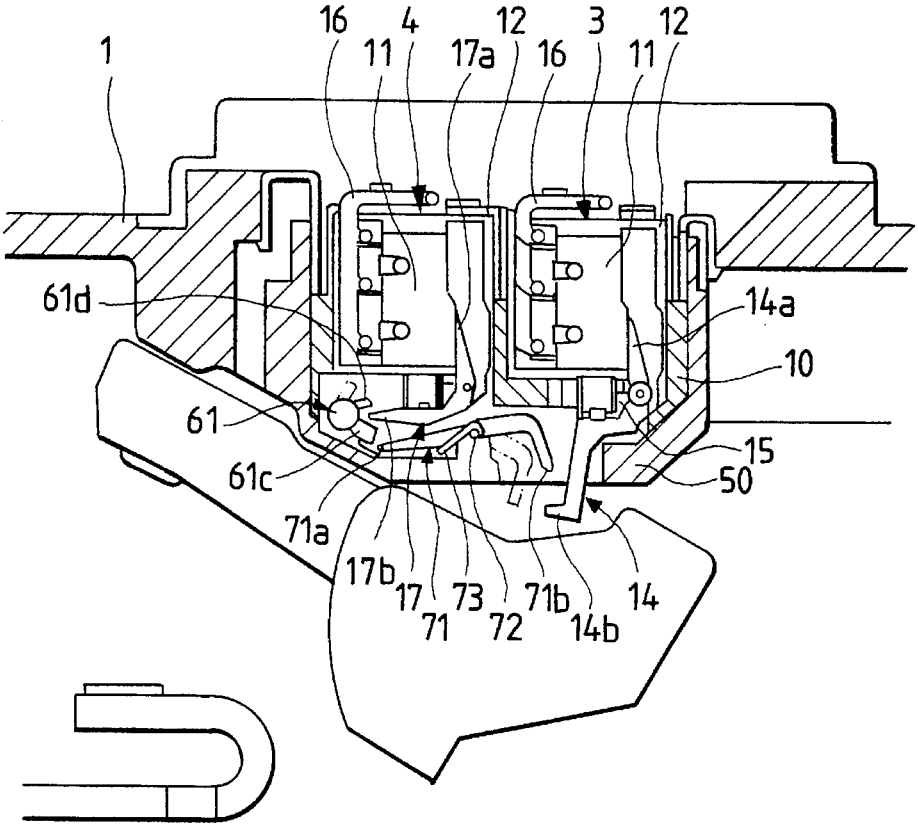
FIG. 37 is a sectional view of an alarm switch and an auxiliary switch in the mechanism with which the mounting or demounting of the accessory or accessories is permitted only when the circuit breaker is in "trip" state.
Figure 38:
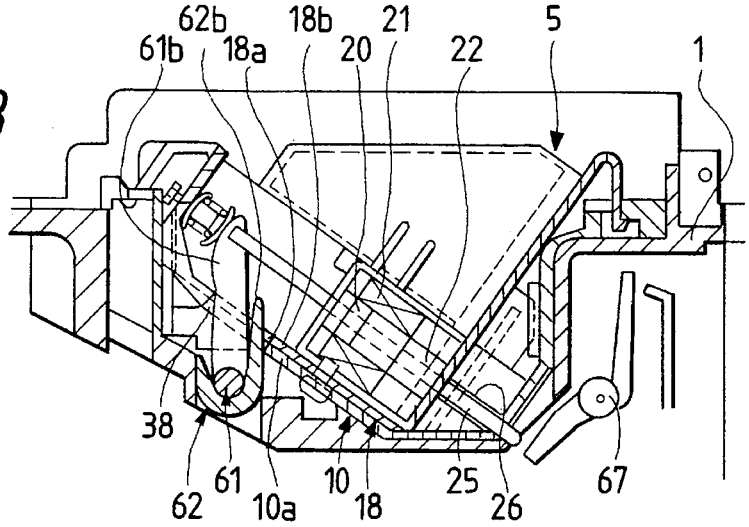
FIG. 38 is a diagram showing the circuit breaker which is in "trip" state, corresponding to FIG. 36.

34 is a perspective view showing an inter-face piece, corresponding to FIG. 20. FIGS. 35(A), 35(B) and 35(C) are a left side view, a front view, and a right side view of an operating shaft, respectively, corresponding to FIGS. 21(A), 21(B) and 21(C). FIG. 36 is a sectional view showing a trip unit with the circuit breaker in "on" state or in "off" state, corresponding to FIG. 8. FIG. 37 is a sectional view showing an alarm switch and an auxiliary switch with the circuit breaker in "on" state or in "off" state, corresponding to FIG. 6. FIG. 38 is a diagram showing the circuit breaker which is in "trip" state, corresponding to FIG. 36.

Figure 34:
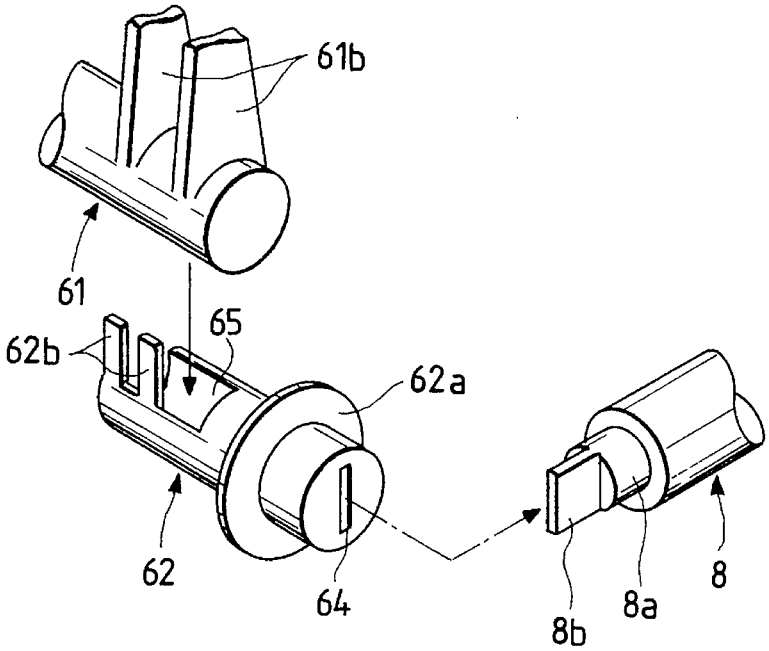
FIG. 34 is a perspective view showing a inter-phase piece in a mechanism with which the mounting or demounting of the accessory or accessories is permitted only when the circuit breaker is in "trip" state.

In the embodiment, as shown in FIG. 34, interference pieces 62*b* are extended from one side of a groove 61 formed in an inter-phase piece 62 in such a manner that they confront with the reset lever 61*b* of the operating shaft 61. The other parts of the inter-phase piece 62 are the same as those of the one shown in FIG. 20.

The interference pieces 62*b* of the inter-phase piece 62 are inserted into the trip unit 5 through the windows 38 of the base 10 and the window 18*a* of the unit base 18, and they are positioned with respect to the base 10 and the unit base 18 as shown in FIG. 36.

As shown in FIGS. 35(A) through 35(C), interference protrusions 61*d* are extended from the operating shaft 61 in such a manner that they overlap the operating levers 61*c*. The other parts of the operating shaft 61 are the same as those of the one shown in FIGS. 21(A) through 21(C).

The interference protrusions 61*d* of the operating shaft 61 are positioned above the lower end portion 17*b* of the actuator 17 of the alarm switch 4 in such a manner that the interference protrusions 61*d* confront with the lower end portion 17*b* of the actuator 17.

As shown in FIG. 37, the cover 1 has an interlock lever 71 which is substantially S-shaped. The interlock lever 71 is swingably supported on the cover partition wall 50 through a pin 72, and it is urged clockwise in FIG. 7 by a twist spring 73 interposed between the interlock lever itself and the partition wall 50.

The left end portion 71*a* of the interlock lever 71 is abutted against the operating levers 61*c* of the operating shaft 61 at all times, so that the interlock lever 71 is locked as shown in FIG. 37, and the left end portion 71*b* is confronted with the lower end portion 14*b* of the actuator 14 of the auxiliary switch 3. The lower end portion 14*b* of the actuator 14 is L-shaped in the embodiment.

When it is tried to remove the base 10 on which for instance the trip unit 5 has been mounted from the cover 1 in FIG. 36, or when it is tried to mount the base on the base 1 as shown in FIG. 36, then as is seen from FIG. 36, the edges 10*a* of the base 10 which define the windows 38 abut against the interference pieces 62*b*, so that the base 10 cannot be removed from or mounted on the cover 1. On the other hand, when the circuit breaker is in "trip" state as shown in FIG. 38, the interference pieces 62*b* are held upright; that is, they are not abutted against the edges 10*a* of the base 10, thus permitting the mounting or demounting of the base 10.

When it is tried to remove the trip unit 5 from the base 10 mounted on the cover 1 in FIG. 36, or when it is tried to mount the trip unit on the base 10 as shown in FIG. 36, the edge 18*b* of the unit base 18 which defines the window 18*a* abuts against the interference pieces 62*b*, so that the trip unit cannot be removed from or mounted on the base 10. On the other hand, when the circuit breaker is in "trip" state as shown in FIG. 38, the interference pieces 62*b* are held upright; that is, they are not abutted against the edge 18*b* of the unit base 18, thus permitting the mounting or demounting of the trip unit 5.

When it is tried to remove the alarm switch 4 from the base 10 in FIG. 37, the lower end portion 127*b* of the actuator 17 abuts against the interference protrusions 61*d* of the operating shaft 61, thus inhibiting the removal of the alarm switch 4. When, on the other hand, it is tried to mount the alarm switch 4 on the base 10 as shown in FIG. 37, then the lower end portion 17*b* of the actuator 17 abuts against the interference protrusions 61*d*, so that it is turned clockwise in FIG. 37 so as to be free. However, it is no longer be free when the upper end portion 17*a* abuts against the case 12 of the alarm switch 4. Thus, the alarm switch 4 cannot be mounted on the base 10.

Similarly, when it is tried to remove the auxiliary switch 3 from the base 10, the lower end portion 14*b* of the actuator 14 abuts the right end portion 71*b* of the interlock lever 71, so that the interlock lever 71 is turned counterclockwise so as to be free. However, in this operation, the left end portion 71*b* abuts against the cover partition wall 50, thus inhibiting the removal of the auxiliary switch 3. When it is tried to mount the auxiliary switch 3 on the base 10 as shown in FIG. 37, the lower end portion 14*b* of the actuator 14 abuts against the right end portion 71*b* of the interlock lever 71 which has been locked by the operating levers 61*c* of the operating shaft 61. Hence, the auxiliary switch 3 cannot be mounted on the base 10.

When, on the other hand, the circuit breaker is in "trip" state with the interference protrusions 61*d* positioned as indicated by the chain line in FIG. 37, the interference protrusions 61*b* do not abut against the actuator 17, and therefore the mounting or demounting of the alarm switch 4 can be achieved. When the circuit break is in "trip" state, the operating levers 61*c* are set away from the left end portion 71*a* of the interlock lever 71. Therefore, the interlock lever 7 is released from the operating levers 61*c*, so that it is turned clockwise to the position indicated by the chain line by the elastic force of the twist spring 73. As a result, the lower end portion 14*b* of the actuator 14 does not abut against the right end portion 71*b* of the interlock lever 71. Hence, the mounting or demounting of the auxiliary switch 4 can be achieved.

As was described above, the mounting or demounting of the accessories can be achieved only when the circuit breaker is in "trip" state. Thus, the accessory mounting or demounting operation can be performed safely at all times.

Figure 39:
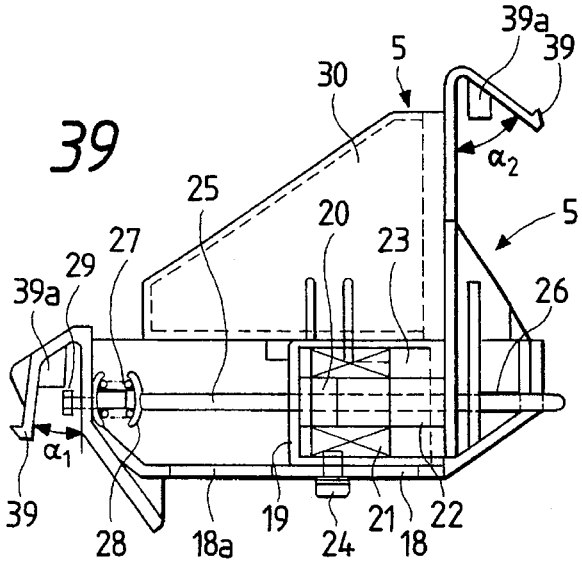
FIG. 39 is a side view of a trip unit which is so designed as to be able to mount on the base more tightly.
Figure 40:
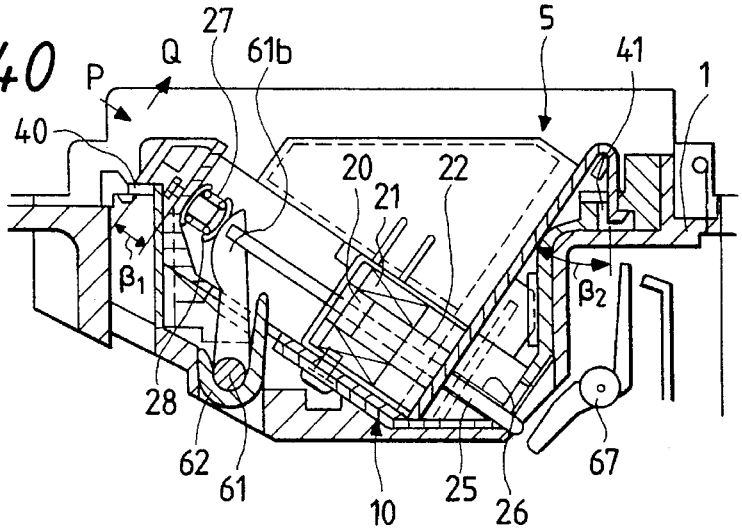
FIG. 40 is a vertical sectional view of the trip unit shown in FIG. 39 is mounted on the base.

FIGS. 39 and 40 show another embodiment of the invention which is so improved that the trip unit 5 can be more tightly and closely mounted on the base 10. More specifically, FIG. 39 is a side view of a trip unit 5, and FIG. 40 is a vertical sectional view of the trip unit mounted on the base 10.

In the embodiment, the hooks 39 of the trip unit 5 are so designed that when they are free as shown in FIG. 39, they are opened wider than in the case where the trip unit 5 is mounted as shown in FIG. 40; in other words, the hooks 39 are so designed as to meet $\alpha_1>\beta_1$, and $\alpha_2>\beta_2$ where $\alpha_1$ and $\alpha_2$ are the opening angles of the hooks in the case of FIG. 39, and $\beta_1$ and $\beta_2$ are the opening angles of the hooks in the case of FIG. 40.

Hence, when the trip unit 5 is mounted on the base, the force of restoration of the hooks 39 elastically deformed eliminates the play of the trip unit in the front-to-rear direction (the right-to-left direction in FIG. 40). In addition, the vertical component of the force of restoration of the left hook 39 pushes the trip unit against the bottom of the base 10, thus preventing the trip unit from being raised.

The trip unit 5 set as shown in FIG. 40 can be removed as follows: The left hook 39 is disengaged by pushing it with the finger in the direction of the arrow P, and the trip unit 5 is raised by turning it about the right hook 39 in the direction of the arrow Q. The trip unit 5 can be mounted as follows: First, the right hook 39 is engaged with the edge of the rectangular hole 41, and then the left hook 39 is inserted into the rectangular hole 40 while being pushed with the finger in the direction of the arrow P.

Each of the hooks 39 includes a stopper piece 39*a* on its inner surface. The provision of the stopper piece 39*a* is to eliminate a difficulty that, when the trip unit is mounted on or removed from the base, the inside of the hook is excessively deformed to the extent that the hook is damaged.

The above-described technical concept that the trip unit is mounted on the base with the hooks maintained elastically deformed can be applied to the case where the base 10 is mounted on the cover 1.

Figure 41:
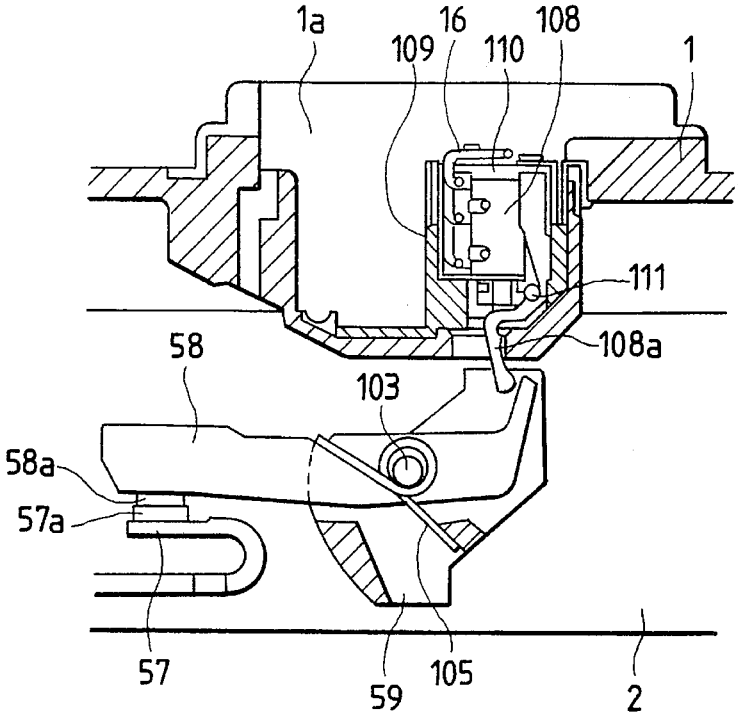
FIG. 41 is a vertical sectional view of a still another embodiment of this invention, showing the states of essential components of a circuit breaker in "on" state in which the contacts have not been worn out yet.
Figure 42:
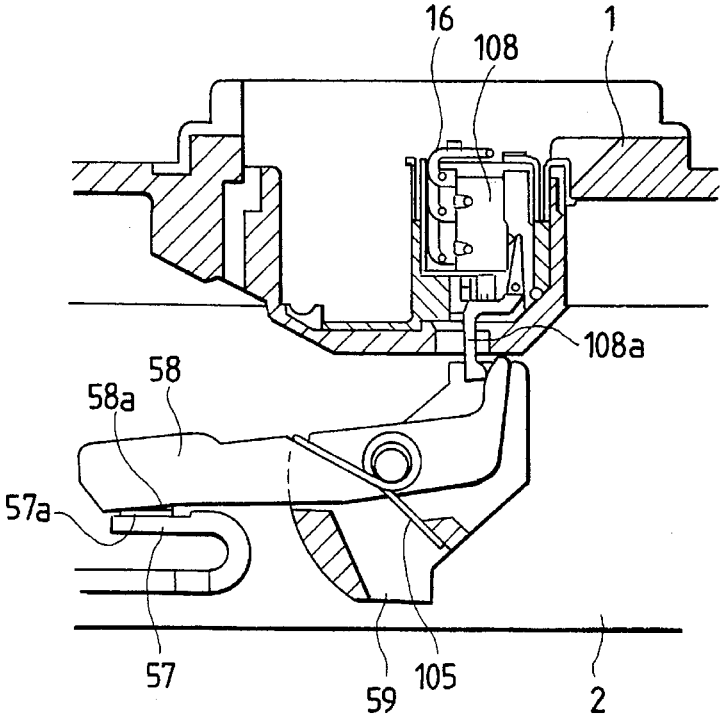
FIG. 42 is a vertical sectional view showing the states of the essential components of the circuit breaker in which the contacts have been worn out.

FIGS. 41 and 42 show still another embodiment of the invention in which the swing motion of a movable contact piece operates the operating lever of a contact wear indicating switch. More specifically, FIG. 41 is a vertical sectional view showing the states of essential components of a circuit breaker in "on" state in which the contacts are not worn out yet, and FIG. 42 is a vertical section view showing the states of the essential components of the circuit breaker in which the contacts have been worn out.

As shown in FIG. 41, the movable contact piece 58 is swingably supported through a supporting pin 103 on a holder 59, and the latter 59 is swingably supported through a switching shaft (not shown) on the casing 2 of a circuit breaker body. The holder 59 thus supported is swung about the switching shaft by a switching mechanism (not shown). A twist spring, namely, a contact spring 105 is interposed between the movable contact piece 58 and the holder 59, to urge the movable contact piece 58 counterclockwise in the figure, or towards a stationary contact piece 57. When the circuit breaker is in "on" state, the movable contact piece 58 is pushed against the stationary contact piece 57, thus bending the contact spring 105. The elastic force of the contact spring 105 thus bent causes the movable contact 58*a* of the movable contact piece 58 and the stationary contact 57*a* of the stationary contact piece 57 to push each other with a predetermined contact pressure.

On the other hand, a contact wear indicating switch 108, which is made up of a microswitch, is mounted on a cover 1 set on the casing 2. The contact wear indicating switch 108 is held in a case 109; that is, it is in the form of a cassette. The contact wear indicating switch 108 is detachably mounted through a base 110 in a recesses 1*a* formed in the cover 1. The contact wear indicating switch 108 has an operating lever 108*a*, which is supported through a pin 111 on the case 109 in such a manner that its operating end portion is confronted with the rear end portion of the movable contact piece 58 with a space therebetween.

FIG. 42 shows a state of the circuit breaker in which the amount of wear of the contacts has reached a critical value. As the movable contact 58*a* and the stationary contact 57*a* are worn out, the movable contact 58*a* is swung counterclockwise as much as the amount of wear. When the amount of wear reaches a critical value, the rear end portion of the movable contact piece 58 pushes the operating lever 108*a* as shown in FIG. 42 to operate the contact wear indicating switch 108, so that the latter outputs a signal, which is transmitted through a lead wire 16.

Figure 43:
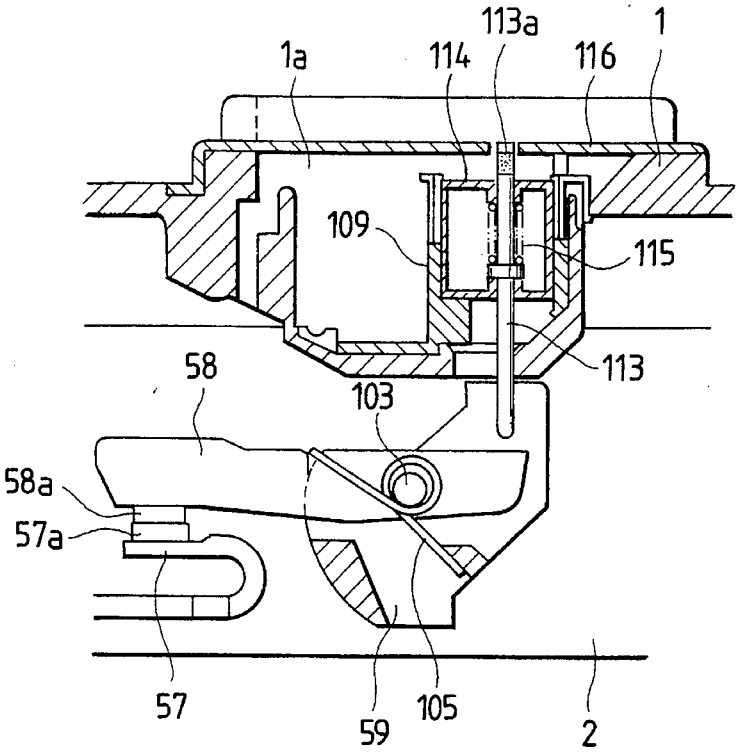
FIG. 43 is a vertical sectional view of a still another embodiment of the invention, showing the states of essential components of a circuit breaker in "on" state in which the contacts have not been worn out yet.
Figure 44:
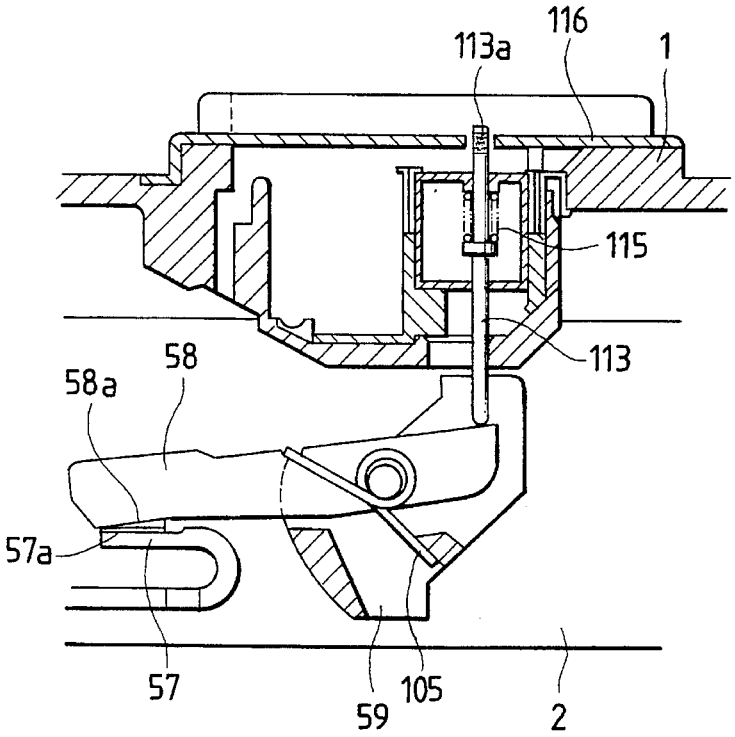
FIG. 44 is a vertical sectional view showing the states of the essential components of the circuit breaker of FIG. 43 in which the contacts have been worn out.

FIGS. 43 and 44 show still another embodiment of the invention in which the swing motion of a movable contact piece causes a contact wear indicating bar to stick out of the circuit breaker. More specifically, FIG. 43 is a vertical sectional view showing the states of essential components of the circuit breaker in "on" state in which the contacts are not worn out yet, and FIG. 44 is a vertical section view showing the states of the essential components of the circuit breaker in which the contacts have been worn out.

As shown in FIG. 43, the contact wear indicating bar 113 is provided in the casing 2 of the circuit breaker body. The contact wear indicating bar 113 is vertically slidably held in a case 114; that is, it is in the form of a cassette. The contact wear indicating bar 113 is detachably mounted through a base 110 in a recess 1*a* of the cover 1 of the circuit breaker body. A compression spring, namely, a return spring 115 is inserted between the contact wear indicating bar 113 and the case 114 so as to push down the contact wear indicating bar to its lowest position as shown in FIG. 43. Under this condition, the upper end portion (head) of the contact wear indicating bar 113 is exposed outside through a through-hole in an auxiliary cover 116 covering the recess 1*a*, and the lower end portion of the bar 113 is confronted with the rear end portion of the movable contact piece 58 with a gap therebetween. The contact wear indicating bar 113 has a color mark 113*a* on the upper end portion which indicates the limit of wear. The other components of the circuit breaker are the same as those of the circuit breaker shown in FIG. 41.

In the case of FIG. 43, the end face of the upper end portion of the contact wear indicating bar 113 is substantially flush with the upper surface of the auxiliary cover 16. As the movable contact piece 1 is swung with the movable contact 58*a* and the stationary contact 57*a* worn out as was described before, the contact wear indicating bar 113 is gradually lifted by the rear end portion of the movable contact piece 58 against the elastic force of the return spring 115, so that the upper end portion of the contact wear indicating bar 113 is protruded from the auxiliary cover 116. When the contacts are worn out maximumly, as shown in FIG. 44 the color mark 113*a* appears outside, thus indicating the fact that the amount of wear has reached the critical value.

Figure 45:
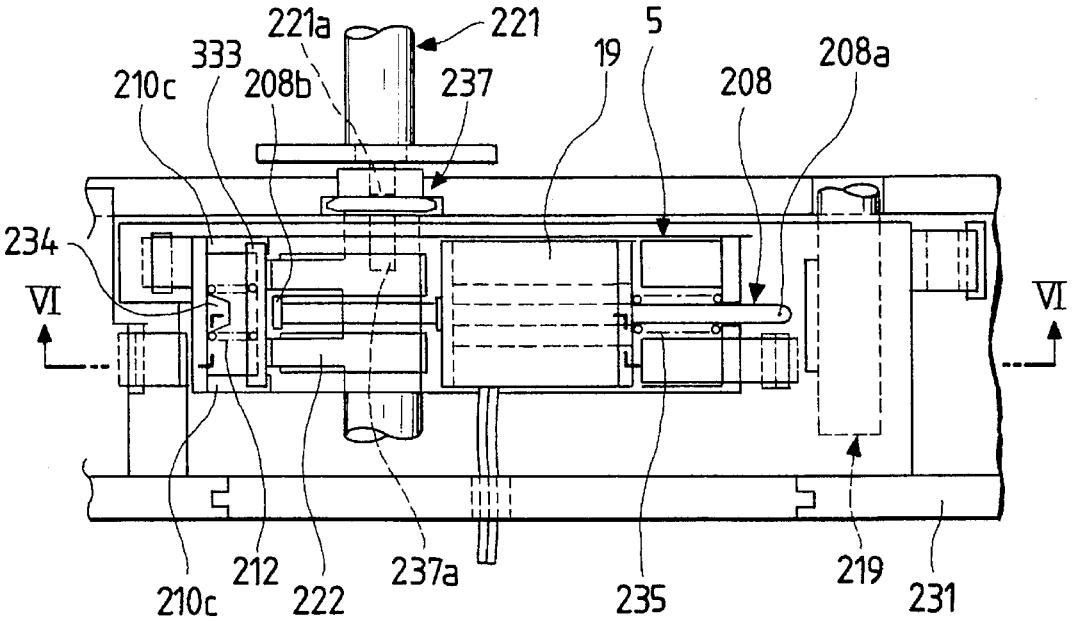
FIG. 45 is a plan view showing a still another embodiment of the invention.
Figure 46:
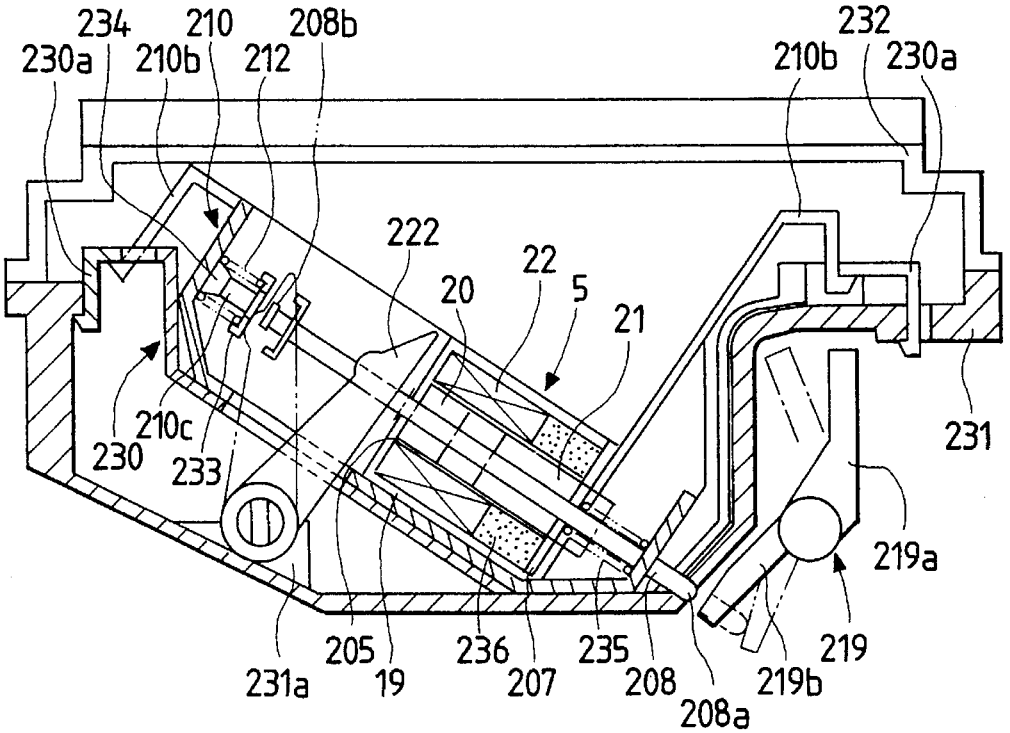
FIG. 46 is a sectional view taken along line VI—VI in FIG. 45.

FIGS. 45 and 46 shows still another embodiment of the invention in which, during the trip operation of a circuit breaker, its trip unit is reset. More specifically, FIG. 45 is a plan view of the embodiment, and FIG. 46 is a sectional view taken along line VI—VI in FIG. 45.

As shown in FIGS. 45 and 46, the trip unit 5 is fixedly mounted on a boat-shaped base 210 which is formed by molding resin; that is, the trip unit 5 and the base 210 are provided as one unit. This one unit is detachably mounted through an engaging leg 210*b*, which is integral with the base 210, on an accessory base 230 which is also formed by molding resin.

Hence, accessories (such as a voltage trip unit, an auxiliary switch, and an alarm switch) other than the trip unit shown can be mounted on the accessory base 230. Those accessories can be freely mounted or demounted with respect to a cover 231. In FIG. 46, reference numeral 232 designates an auxiliary cover adapted to cover the above-described accessories including the trip unit 5. The auxiliary cover 232 is mounted on the cover 231 in such a manner that it can be freely opened or closed.

In the trip unit 5, a push bar 108 slidably penetrates a stationary iron core 20, and it further penetrates a movable iron core 21 and is fixed to the latter 21. The front end portion 108*a* of the push bar 108 is confronted with a second operating arm 219*b* of a trip cross bar 219. A first operation arm 219*a* of the trip cross bar 219 is confronted with an over-current trip unit (not shown). The base end portion of the push bar 208 is confronted through a spring receiver 233 to a trip spring 212.

One end portion of the trip spring 212 is fitted in a spring seat 234 formed in the base 210, and the other end portion is coupled to the spring receiver 233. The spring receiver is a rectangular plate, which has angular grooves (not shown) in the right and left end portions. The angular grooves are slidably engaged with stripe-shaped protrusions 210*c* of the base 210; that is, the spring receiver is slidably guided by the stripe-shaped protrusions 210*c*. Further in FIGS. 45 and 46, reference numeral 235 designates a compression spring, namely, a return spring which is interposed between the movable iron core 21 and the base 210.

In the embodiment, an electromagnetic coil 22 is a DC coil, and a permanent magnet 236 is provided adjacent to the electromagnetic coil 22 in such a manner that the magnetic flux of the permanent magnet 236 is equal in direction to that of the electromagnetic coil 22. The permanent magnet 236 serves as a base load to attract the movable iron core 21, and the electromagnetic coil 22 may be smaller in capacity as much.

Further in FIGS. 45 and 46, reference numeral 222 designates a fork-shaped operating lever. One end portion of the operating lever 22 is coupled to a resin piece 237 to a latch shaft 221, and the other end portion is rotatably supported on a bearing seat 231*a* formed in the cover 231. The latch shaft 221 has a protrusion 221*a* on the end face which is extended diametrically, and the resin piece 237 is engaged with the protrusion 221*a* from above through its groove formed in correspondence to the latter 221*a*. Similarly, the operating lever 222 is engaged with a protrusion 237*a* of the resin piece 237 from above through its groove. This structure makes it possible to remove the resin piece 237 and the operating lever 222 from the latch shaft 221 with ease when the trip unit 5 is removed from the cover 231.

Normally the movable iron core 21 is attracted and retained by the stationary iron core 20, and the base end portion 208*a* of the push bar 208 compresses the trip spring 212. When a circuit voltage applied to the electromagnetic coil 22 is decreased to a predetermined value or less, the movable iron core 21 is moved away from the stationary iron core 20 by the elastic force of the trip spring 212 acting on the base end portion 208 of the push bar 208, thus being moved to the right in the figure while compressing the return spring 235. Accordingly, the push bar 208 is moved to the position indicated by the chain line; that is, the front end portion 208*a* pushes the operating arm 219*b* so that the trip cross bar 219 is turned counterclockwise in FIG. 46. As a result, the latch (not shown) is released, and the circuit breaker is turned off.

When the circuit breaker is tripped in the above-described manner, the operating lever 222 coupled to the latch shaft 221 is turned from the reset position indicated by the solid line to the trip position indicated by the chain line. During this operation, the operating lever pushes down the spring receiver 233 from the position indicated by the chain line, thus compressing the trip spring 212. As a result, the push bar 208 is released from the trip spring 212, and therefore it is moved to the left by the elastic force of the return spring 235, thus bringing the movable iron core 21 into contact with the stationary iron core 20. If, in this case, the circuit voltage has been restored, then the movable iron core 21 is attracted again, so that the trip unit 5 is reset.

When the circuit breaker is reset, the operating lever 222 is turned clockwise from the position indicated by the chain line. If, in this case, the circuit voltage has not been restored yet, as the operating lever is turned the push bar 208 is moved by the elastic force of the trip spring 212, to turn the trip cross bar 219. Hence, it becomes impossible to reset the circuit breaker, and similarly as in the case of the above-described embodiment, the succeeding "on" operation of the circuit breaker is not permitted.

When the trip unit 5 is reset, the operating lever 222 strikes the spring receiver 233; however, no great impact force is produced, because the operating lever 22 is smaller both in size and in weight than the movable iron core, and therefore its energy of motion is small; that is, it is absorbed by the action of cushion of the trip spring 212. In the circuit breaker shown in FIGS. 45 and 46, the force of operating the operating lever 222 is not applied to movable parts such as for instance the push bar 208, and it is used only to compress the trip spring 212 to release the push bar. Therefore, the trip unit will never be damaged by the force.

As described above, in the circuit breaker of the invention, the accessories are mounted on the base, and the base is mounted on the cover. Hence, a variety of accessories different in configuration and size can be freely mounted on the circuit breaker body, and in this case, it is unnecessary to make the recesses of the cover intricate in configuration.

Furthermore, a plurality of accessories can be mounted as one unit, and the change in combination of the accessories, addition of accessories, and the wiring of them can be achieved with the accessory module separated from the circuit breaker. Hence, when compared with the case where those operations are carried out in a narrow circuit board, the manufacture of the circuit breaker of the invention is greatly reduced in the number of manufacturing steps, and the improved in safety.

Further, as was described above, in the embodiment, the trip unit is so designed as to be reset with the latch shaft, and therefore if the circuit voltage is not restored yet when the trip unit is reset, then the circuit breaker is not reset. Hence, the difficulty is eliminated that the circuit breaker is turned on with the circuit voltage decreased, and the movable contact piece starts the "off" operation abruptly during the "on" operation, thus giving an excessively great load to the mechanism.

Furthermore, the embodiment is free from the difficulty that, in resetting the trip unit, the operating force applied, for instance, to the reset lever is decreased, so that the reset mechanism is damaged.

Thus, in the circuit breaker, the switching mechanism and the trip unit resetting mechanism may not be so high in rigidity, which permits miniaturization of the circuit breaker.

What is claimed is:

1. A circuit breaker comprising:

a container made of electrically insulating material, said container being constituted by a casing and a cover;

a switching mechanism contained in said container;

partition walls defining a recess in said cover, said recess being separated from an interior of said container by said partition walls;

a base made of electrically insulating material, said base being detachably mounted in said recess formed in said cover; and an accessory in the form of a cassette detachably mounted to said base, wherein said cover has a cover side wall in which an opening is formed, and said base has a base side wall in which a groove is formed, said base side wall being confronted with said opening formed in said cover side wall, said groove accommodating lead wires of said accessory.

2. A circuit breaker as claimed in claim 1, further comprising a cover member which is detachably engaged with said base for retaining said lead wires of said accessory.

3. A circuit breaker as claimed in claim 1, further comprising a terminal board detachably engaged with said base for retaining said lead wires of said accessory.

4. A circuit breaker comprising:

a container made of electrically insulating material, said container being constituted by a casing and a cover;

a switching mechanism contained in said container;

partition walls defining a recess in said cover, said recess being separated from an interior of said container by said partition walls:

a base made of electrically insulating material, said base being detachably mounted in said recess formed in said cover;

an accessory in the form of a cassette detachably mounted to said base; and an alarm switch arranged beside said switching mechanism, said alarm switch being operated by an operating shaft which is coaxially coupled to a latch pin which is rotated together with a latch of said switching mechanism.

5. A circuit breaker comprising:

a container made of electrically insulating material, said container being constituted by a casing and a cover;

a switching mechanism contained in said container;

partition walls defining a recess in said cover, said recess being separated from an interior of said container by said partition walls;

a base made of electrically insulating material, said base being detachably mounted in said recess formed in said cover; and accessory in the form of a cassette detachably mounted to said base, wherein said accessory comprises a plurality of accessories detachably mounted on said base, and wherein said accessories include a trip unit and an alarm switch arranged beside said switching mechanism, said trip unit being reset and said alarm switch being operated by an operating shaft coaxially coupled to a latch pin which is rotated together with a latch of said switching mechanism.

6. A circuit breaker as claimed in claim 5, wherein said accessories further include an auxiliary switch arranged behind said alarm switch, said auxiliary switch being operated by a holder supporting a movable contact.

7. A circuit breaker as claimed in claim 4, further comprising an inter-phase piece having an axially extending U-shaped groove and connected to one end portion of said latch pin, said operating shaft being coupled to said latch pin by fitting one end portion thereof in said U-shaped groove, another end portion of said operating shaft being engaged with a groove formed in one of said cover and casing, and said operating shaft being held in a groove formed in said base.

8. A circuit breaker as claimed in claim 7, wherein said operating shaft is held by said base.

9. A circuit breaker comprising:

a container made of electrically insulating material which comprises a casing and a cover;

a switching mechanism contained in said container, said switching mechanism having a latch;

a partition wall defining a recess in said cover, said recess being separated from an interior of said container by said partition wall;

an accessory detachably mounted in said recess;

a trip unit;

an alarm switch arranged beside said switching mechanism together with said trip unit, said trip unit and said alarm switch being adjacent to each other;

a latch pin rotatably connected with said latch of said switching mechanism; and an operating shaft coaxially coupled to said latch pin;

wherein said trip unit is reset and said alarm switch is operated by said operating shaft.

* * * * *

UNITED STATES PATENT AND TRADEMARK OFFICE

CERTIFICATE OF CORRECTION

PATENT NO. : 5,581,219

DATED : December 03, 1996

INVENTOR(S) : Eiji NOZAWA et al.

It is certified that error appears in the above-indentified patent and that said Letters Patent is hereby corrected as shown below:

Claim 5, column 19, line 40, insert --an-- before "accessory".

Signed and Sealed this

Tenth Day of June, 1997

Bruce Lehman

*Attest:*

BRUCE LEHMAN

*Attesting Officer*

*Commissioner of Patents and Trademarks*